United States Patent [19]

Somero et al.

[11] Patent Number: 4,655,633

[45] Date of Patent: Apr. 7, 1987

[54] SCREEDING APPARATUS AND METHOD

[75] Inventors: David W. Somero, Wheeler Rd.; Paul J. Somero, Gibbs Rd., both of New Ipswich, N.H. 03071; Philip J. Quenzi, Atlantic Mine, Mich.

[73] Assignees: David W. Somero; Paul J. Somero, both of New Ipswich, N.H.

[21] Appl. No.: 779,258

[22] Filed: Sep. 23, 1985

[51] Int. Cl.[4] ..... E01C 23/07; E01C 19/26; E01C 19/40

[52] U.S. Cl. ..... 404/75; 404/84; 404/118; 425/60

[58] Field of Search ..... 404/75, 84, 114, 118, 404/120; 425/60, 446; 264/31, 293, 310

[56] References Cited

U.S. PATENT DOCUMENTS

| | | | |
|---|---|---|---|
| 2,146,101 | 2/1939 | Weber | 94/48 |
| 2,306,671 | 12/1942 | Tamblyn | 72/128 |
| 2,746,366 | 5/1956 | Reed | 94/45 |
| 3,221,618 | 12/1965 | Hudis | 94/45 |
| 3,309,971 | 3/1967 | Domenighetti | 94/45 |
| 3,412,658 | 11/1968 | Griffin | 94/45 |
| 3,450,011 | 6/1969 | Godbersen | 94/45 |
| 3,526,173 | 9/1970 | Brandstetter et al. | 94/44 |
| 3,541,931 | 11/1970 | Godbersen | 94/45 |
| 3,541,932 | 11/1970 | Hodson | 94/39 |
| 3,543,939 | 7/1969 | Pollitz et al. | 94/46 |
| 3,550,511 | 12/1970 | Potts | 94/46 |
| 3,602,112 | 8/1977 | Burks | 94/44 |
| 3,602,115 | 8/1971 | Hanson | 94/46 |
| 3,604,512 | 9/1971 | Carter et al. | 172/4.5 |
| 3,636,832 | 1/1972 | Schrimper et al. | 94/46 |
| 3,638,540 | 2/1970 | Williams | 94/46 |
| 3,779,661 | 12/1973 | Godbersen | 404/72 |
| 3,779,662 | 12/1973 | Smith | 404/98 |
| 3,816,014 | 6/1974 | Klopf | 404/114 |
| 3,873,226 | 3/1975 | Teach | 404/84 |
| 3,907,451 | 9/1975 | Fisher et al. | 404/101 |
| 3,953,145 | 4/1976 | Teach | 404/84 |
| 3,959,977 | 6/1976 | Godbersen | 61/63 |
| 4,073,592 | 2/1978 | Godbersen et al. | 404/89 |
| 4,266,917 | 5/1981 | Godbersen | 425/64 |
| 4,340,351 | 7/1982 | Owens | 425/456 |
| 4,349,294 | 9/1982 | Allen | 404/110 |
| 4,371,287 | 2/1983 | Johansson | 404/84 |
| 4,466,757 | 8/1984 | Allen | 404/114 |
| 4,470,783 | 9/1984 | Friebel et al. | 404/118 |
| 4,484,834 | 11/1984 | Rowe et al. | 404/84 |

FOREIGN PATENT DOCUMENTS 1093166 5/1955 France .

OTHER PUBLICATIONS

Ford Industrial Buyer's Guide, 1984–1985, Ford Motor Company.

Sifco Bearings brochure, 1984, Sifco Bearings, Subsidiary Sifco Industries, Inc., 1500 Nagle Road, Avon, Ohio 44011, including drawing dated May 6, 1985.

Spectra-Physics, Product Information Models R2S, R2N Prinz Albert Receiver, Copyright Sep., 1984, Dayton, Ohio 45424.

(List continued on next page.)

*Primary Examiner*—Stephen J. Novosad
*Assistant Examiner*—Bruce M. Kisliuk
*Attorney, Agent, or Firm*—Price, Heneveld, Cooper, DeWitt & Litton

[57] ABSTRACT

A self-propelled apparatus and method are disclosed for screeding placed and/or poured, uncured concrete or like loose, spreadable materials without use of prepositioned guides or rails. The apparatus includes a frame supported on hydraulically drive, steerable wheels, a cantilevered boom mounted on the frame, and a hydraulically driven, auger-type, vibratory screed either fixedly mounted or mounted for movement along the boom to spread and smooth the concrete as the screed is moved toward the vehicle. Screed control means are included for automatically adjusting the elevation of the screed relative to a laser beacon reference plane positioned off the apparatus such that the finished height of the concrete or other material is controlled within close tolerances. Preferably, the boom is rotatably mounted on the frame and also may be extended and retracted to properly position the screed and ease movement of the vehicle around fixed obstacles. The boom may also be pivoted vertically for screeding sloped surfaces. The method includes propelling the vehicle through uncured concrete or like material while screeding behind the vehicle. Also encompassed is the method of screeding by moving the screed toward the vehicle at a controlled rate.

63 Claims, 20 Drawing Figures

OTHER PUBLICATIONS

Spectra-Physics, Product Information Model CB2OTO Rigid/Manual Mast Control Box, Copyright Sep. 1984, Dayton, Ohio 45424.

Spectra-Physics, Product Information Model 1044-L Long-Range Electronic Level, Copyright Jan., 1985, Dayton, Ohio 45424.

Spectra-Physics, Product Information Model UV9-30-XX Unloading Valve, Copyright Aug., 1984, Dayton, Ohio 45424.

Spectra-Physics, Proc/Spec, Installation Procedure re 4 way, GPM cc valve, drawings dated Nov. 19, 1984 & Feb. 14, 1985, Dayton, Ohio 45424.

Gresen Directional Control Valves, V-20, Gresen Mfg. Co., subsidiary of Dana Corp., P.O. Box 1313, Minneapolis, Minn. 55440, May, 1981.

Lord Industrial Products, Center Bonded Mounts (CB-1100 Series), Safetied Tube Form Mounts (STA Series), 1983, Lord Corp. Industrial Prods. Div., 1635, West 12th St., P.O. Box 10039, Erie, Pa. 16514-0039.

Ausco, Failsafe Brakes for Hydrostatic Drives, Feb., 1985, Auto Specialties Mfg. Co., St. Joseph, Mich. 49085.

Helland, Series 800 S.A.E. C, Model 815-14S, 1984, Helland Research & Engineering, Inc., 2420 Niagra Lane North, Plymouth Minn. 55441-3499.

Morrison's High Frequency Vibrating Screeds, Morrison's Concrete & Equipment, Inc., Charlotte, N.C. 28214, Feb., 1984.

Metal Forms Corporation Speed Screed Advertisement, Milwaukee, Wis., 53212, from "Concrete Construction" magazine, Apr., 1985.

Making Quality Number 1 Makes the Customer Number One, Concrete Construction magazine, Apr., 1985.

Bid-Well, Concrete Finishers advertisement, from "Concrete Construction" magazine, Apr., 1985.

The Growing Gomaco Line, Gomaco Corporation, Ida Grove, Iowa 51445, (Brochure No. G-0577-02) and Gomaco ads re pavers, finishers and screeds from "Concrete Construction" magazine, Feb. and Apr. 1985.

Speed Screed, A Concrete Finisher That's Built to Last, Metal Forms Corporation, Milwaukee, Wis., 53212, Copyright 1982.

Article re paving of Mount Vernon Highway, Virginia from "Concrete Construction" magazine, Feb., 1984.

Atlanta NewCem Profile, Concrete Construction, Feb., 1984.

SCREEDING APPARATUS AND METHOD

BACKGROUND OF THE INVENTION

This invention relates to methods and machines for screeding, i.e., spreading, distributing, smoothing and/or leveling, placed and/or poured, uncured concrete, sand, gravel or like loose, spreadable materials, and, more particularly, to an apparatus and method for screeding such materials with a vehicle either positioned adjacent the uncured concrete or driven through the uncured concrete while screeding the material behind the vehicle without the use of prepositioned guides or rails.

In the concrete placement industry, it is necessary to "strike-off", smooth and level, i.e., "screed" areas of placed and/or poured concrete before curing. Numerous methods and techniques for spreading and leveling the concrete have been used in the past. These include passing an edge of a two by four plank across the top of the concrete as well as more sophisticated, power screeds. For instance, in the construction of bridges or highways, or even large concrete floor areas such as in warehouses, large rail or guide supported screeds are often used. Such screeds include long trusses or beams which span the width of the strip of concrete to be formed and ride on heavy guides or rails adjacent either side of the concrete strip to skim or smooth the top of the concrete between the rails.

In highway construction, slip-form pavers are often used. Such pavers include self-propelled vehicles having hoppers and pouring apparatus for laying a strip of concrete followed by a screed which spreads and smooths the concrete immediately after it is placed and/or poured by the machine. Such machines run on wheels or tracks and follow guide lines or strings such that the concrete strip is laid in the desired path.

Often, smaller concrete laying jobs under 50,000 square feet or those which require low slump concrete do not justify the expense of setting up heavy guides or rails and the movement of large machinery to ride on such rails. Similarly, slip-form pavers are too large to justify use on such small jobs. Moreover, many previously known screeding machines have been unable to lay more than a single strip of concrete in a day since it is necessary that one edge of a previous strip be used as a form, guide or support to lay the next strip. Thus, until the previous concrete strip has hardened, additional strips cannot be laid side by side.

Coupled with the above is the requirement on smaller concrete jobs of forming and/or hand finishing the edges of the concrete areas. If such finish work together with the primary screeding of the main areas is done by hand, the task is highly labor intensive, very time consuming and expensive.

Accordingly, the present invention was devised in recognition of the problems of finishing both large and small placed and/or poured concrete areas, especially those which do not justify the time and expense of moving and setting up heavy, rail guided paving or screeding machines or slip-form pavers. It was also desired to provide an apparatus and method which would significantly reduce the labor involved in laying and finishing large, nonstrip-type concrete areas in a manner which would allow completion in a continuous work session without laying the concrete in side by side strips on successive days. Further, it was desired to provide an apparatus and method which would allow operation for concrete or other loose material finishing by a single operator while providing screeded concrete or smooth, leveled material with close height tolerances in a manner which would allow reduction of labor expense.

SUMMARY OF THE INVENTION

The present invention is a screeding apparatus and method for spreading, distributing, smoothing and/or leveling placed and/or poured, uncured concrete or like loose, spreadable or plastic materials on the ground, on suspended decks, in parking structues or on other surfaces to allow such finishing without the use of large, bulky slip-form pavers or screeding apparatus which require support and operation on preset guides or rails.

In one aspect, the invention is a self-propelled screeding apparatus including a frame, propulsion means on the frame for moving the frame over a surface, a boom, boom support means for mounting the boom in cantilevered fashion from the frame, and screed means for spreading and/or smoothing loose or plastic material such as uncured concrete. Screed mounting means are provided for mounting the screed on the boom for movement with respect to the frame and boom whereby the screed means may be moved along the boom for spreading and/or smoothing the concrete or other material on the ground or another support surface adjacent to the apparatus or may be secured in a predetermined position on the boom for spreading or smoothing the material as the apparatus is moved through the material.

Preferably, the apparatus includes screed control means for automatically controlling the elevation of the screed means with respect to the boom and frame in response to a fixed reference to smooth, spread or level the material. It is also preferred that the boom itself be mounted for 360 degree rotation around the frame and be provided with means for extending and retracting the boom with respect to the frame for ease in movement of the apparatus around fixed obstacles.

In a preferred form, the frame includes upper and lower portions separated by a rotation bearing, the boom being mounted on the upper frame portion and including hydraulic drive motor means for horizontally extending and retracting the boom. In an alternate form, the boom may include a horizontal pivot axis such that the boom may be raised or lowered vertically to allow screeding of inclined or sloped surfaces adjacent the machine.

The screed means itself preferably includes at least one rotational auger for spreading the placed and/or poured concrete laterally across the path of travel of the screed, a strike-off member for smoothing the concrete, as well as a vibration motor for vibrating the entire screed to help smooth and consolidate the concrete or other material. Preferably, the screed means includes elevation apparatus and at least one laser beam receiver mounted thereon for detecting and receiving a laser beacon defining a fixed reference plane. The laser receiver generates an electric signal indicating the position of the screed and receiver relative to the reference plane. Electrical control means responsive to the signals from the laser beacon receiver control operation of fluid valves and cylinders to raise and lower the screed automatically to maintain the desired grade or material height.

Preferably, the apparatus propulsion, boom and screed drives, boom rotation and screed elevation apparatus are all powered hydraulically for control by a single operator through a plurality of flow control valves.

The invention also encompasses a method of screeding uncured concrete with a screeding vehicle including propelling the vehicle through the concrete such that the support means for supporting the vehicle on the ground or another support surface pass directly through the concrete, screeding the uncured concrete with a screed means mounted on the vehicle behind the vehicle support means, and controlling the position of the screed means with respect to a fixed reference located external to the vehicle with a control means on the vehicle.

In addition, a screeding method for uncured concrete with a screeding vehicle is encompassed including positioning a vehicle with a screed movably mounted thereon adjacent an area of uncured concrete, positioning the screed over the uncured concrete at a first position away from the vehicle, engaging the screed means with the concrete at the first position and moving the screed at a controlled rate toward a second position adjacent the vehicle while controlling the elevation of the screed relative to a fixed reference located off the vehicle.

The screeding apparatus and method of the present invention provide numerous advantages over prior known structures and methods. The invention allows the spreading, distributing, smoothing and leveling of large concrete areas at one time without finishing one strip and waiting for it to harden before another strip or area can be completed. No rails or guides for screeding are required since the apparatus supports the screed from a vehicle platform and a cantilevered boom. Moreover, since the vehicle can be driven directly through the uncured concrete, successive areas of large concrete jobs can be finished in order by moving the machine from place to place within the placed and/or poured concrete. The positioning and movement of large heavy finishing machines and supporting rails or guides is thereby eliminated. In addition, the machine and method are useful on smaller jobs previously requiring only hand labor since the machine can either be driven directly to the area requiring finishing or moved to an adjacent area with the screed extended over the area to be finished via its cantilevered boom. In addition, the quality of finished concrete or other material provided with the invention and method is high since the machine works to a highly accurate, fixed laser beacon reference plane and allows concrete or other material heights to be controlled to tolerances within ⅛ of an inch or better.

These and other objects, advantages, purposes and features of the invention will become more apparent from a study of the following description taken in conjunction with the drawings.

DESCRIPTION OF THE PREFERRED EMBODIMENTS

Support Frame and Propulsion Apparatus

Figure 1:
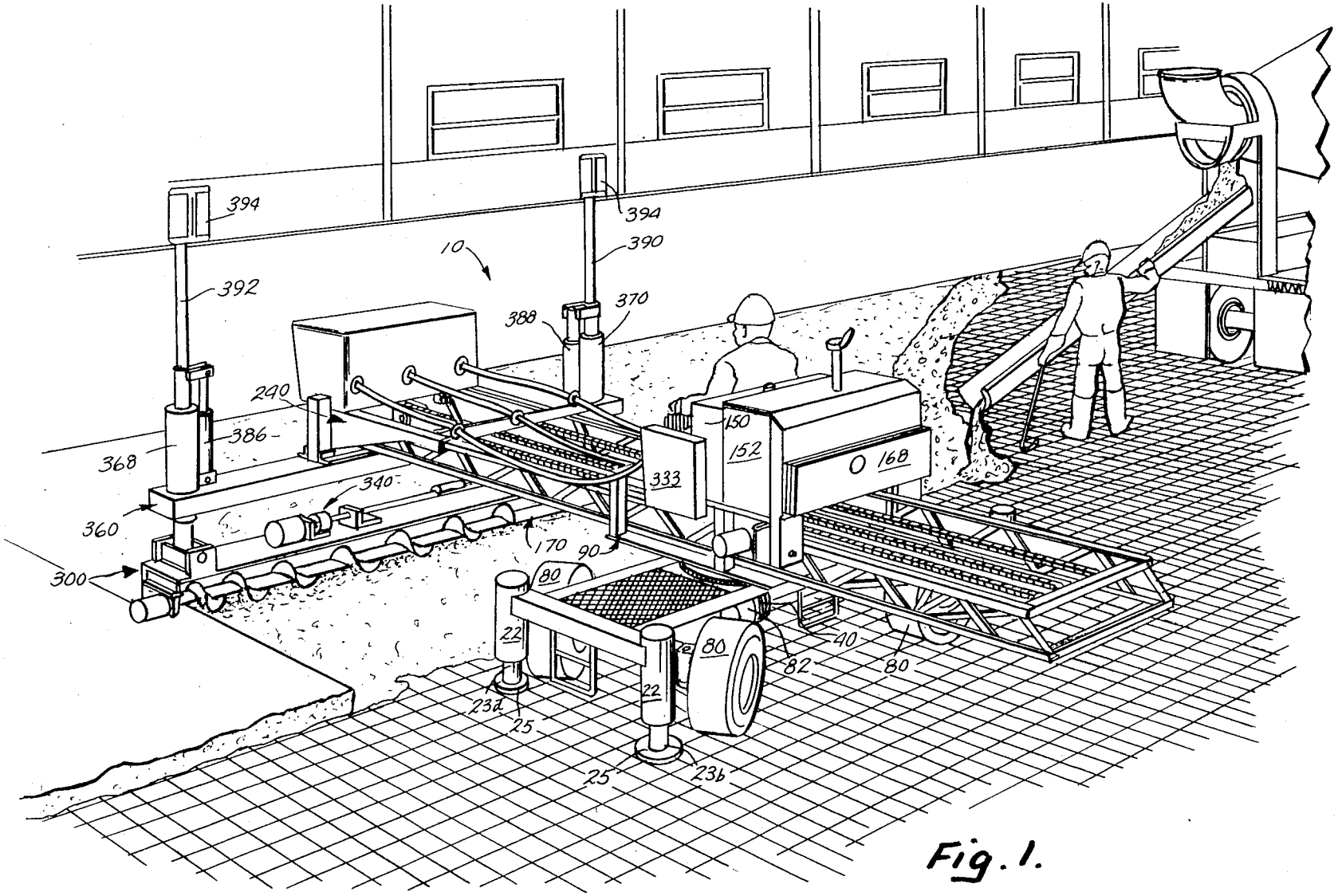
FIG. 1 is a perspective view of the screeding apparatus of the present invention in use while finishing a large concrete floor area such as in a warehouse.

Referring now to the drawings in geater detail, FIGS. 1–4 illustrate a preferred form of the self-propelled screeding apparatus 10 of the present invention. Screeding apparatus or machine 10 is designed for use in closed or open areas but is particularly advantageous in areas where it would be inconvenient to lay support rails or guides and/or move in large rail supported screeding apparatus or slip-form pavers. The screeding machine is also very useful where large areas of concrete are placed and/or poured and finished since the machine avoids the necessity of laying a first strip which must harden before the adjacent strip can be placed and/or poured and finished.

As shown in FIGS. 1–4, the apparatus includes a lower support frame 12 including front and rear propulsion support axles 50, 70 which provide both propulsion and steering capability, four support wheels 80 including rubber tires, an upper frame 90 which is rotatable on a large bearing 130 and includes an operator support platform 112 along with an internal combustion engine 162, a battery 165, hydraulic pumps 163, 164 and tanks 150 for powering the various driven parts of the machine, an operator's seat 154 and appropriate controls for the machine as well as a support for the cantilever boom 170.

Boom 170 extends outwardly from upper frame portion 90 below the operator's platform 112 and is mounted for horizontal extension and retraction on suitable bearings. At one end of boom 170 is mounted a screed support trolley assembly 240 which is suspended screed assembly 300 and a screed support and elevation assembly 360. The automatic screed elevation control system, using laser beacon receivers 394, is included on screed elevation assembly 360 and is connected to an appropriate control 162 mounted on operator platform 112 on upper frame portion 90. By means of the rotatable upper frame portion 90, boom 170 carrying screed trolley assembly 240, screed assembly 300 and screed elevation assembly 360, may be rotated 360 degrees around the lower frame 12 for spreading, distributing, smoothing and/or leveling, i.e., screeding the placed and/or poured, uncured concrete adjacent the machine. As explained hereinafter, the boom may also be rotated such that it extends rearwardly behind frame 12 and axle 70 with screed assembly 300 positioned on trolley assembly 240 behind the rear support wheels 80 and axle 70. In this configuration, the machine 10 may be driven through placed and/or poured, uncured concrete with the smoothing and finishing proceeding behind the rear wheels as the apparatus moves slowly through the concrete. Any tracks are filled in and the concrete or other material is smoothed therebehind.

Figure 18:
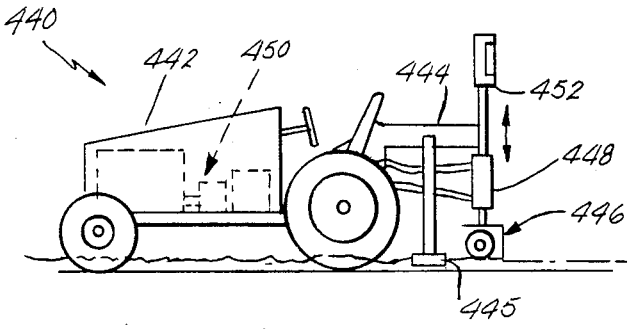
FIG. 18 is a side view of a further alternate form of the screeding apparatus.

Alternatively, a modified screeding machine 440, as shown in FIG. 18, includes a fixed boom and screed assembly wherein only the elevation of the screed is adjustable via an automatic control system referencing a laser beacon reference plane as described hereinafter.

For purposes of the present application, the apparatus and methods described will be understood to principally refer to the finishing, i.e., screeding of previously placed and/or poured, uncured concrete or like loose, spreadable material such as sand, gravel, asphalt and the like previously placed on the ground or on other surfaces such as in parking ramps, on decks, in buildings or the like. The present apparatus and method is especially useful on low slump, uncured concrete. It will be recognized, however, that the present apparatus and method avoids the use of prepositioned guide rails or supports for the screeding apparatus thereby eliminating significant amounts of labor and expense in the concrete finishing operation.

Support Frame, Propulsion System and Operator's Platform

Figure 2:
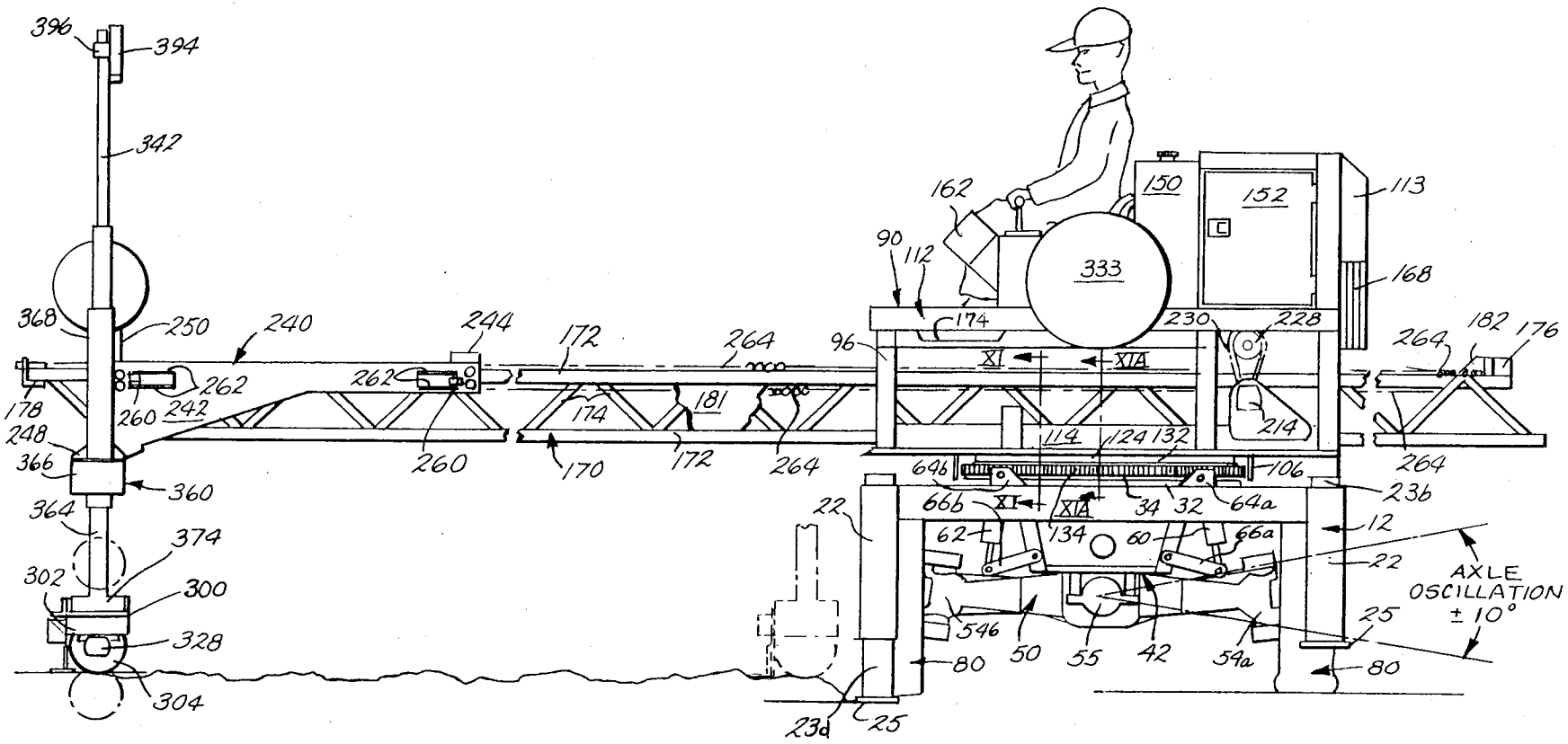
FIG. 2 is a front elevation of the screeding apparatus with the screed support boom and operator platform rotated and shown in side elevation.
Figure 3:
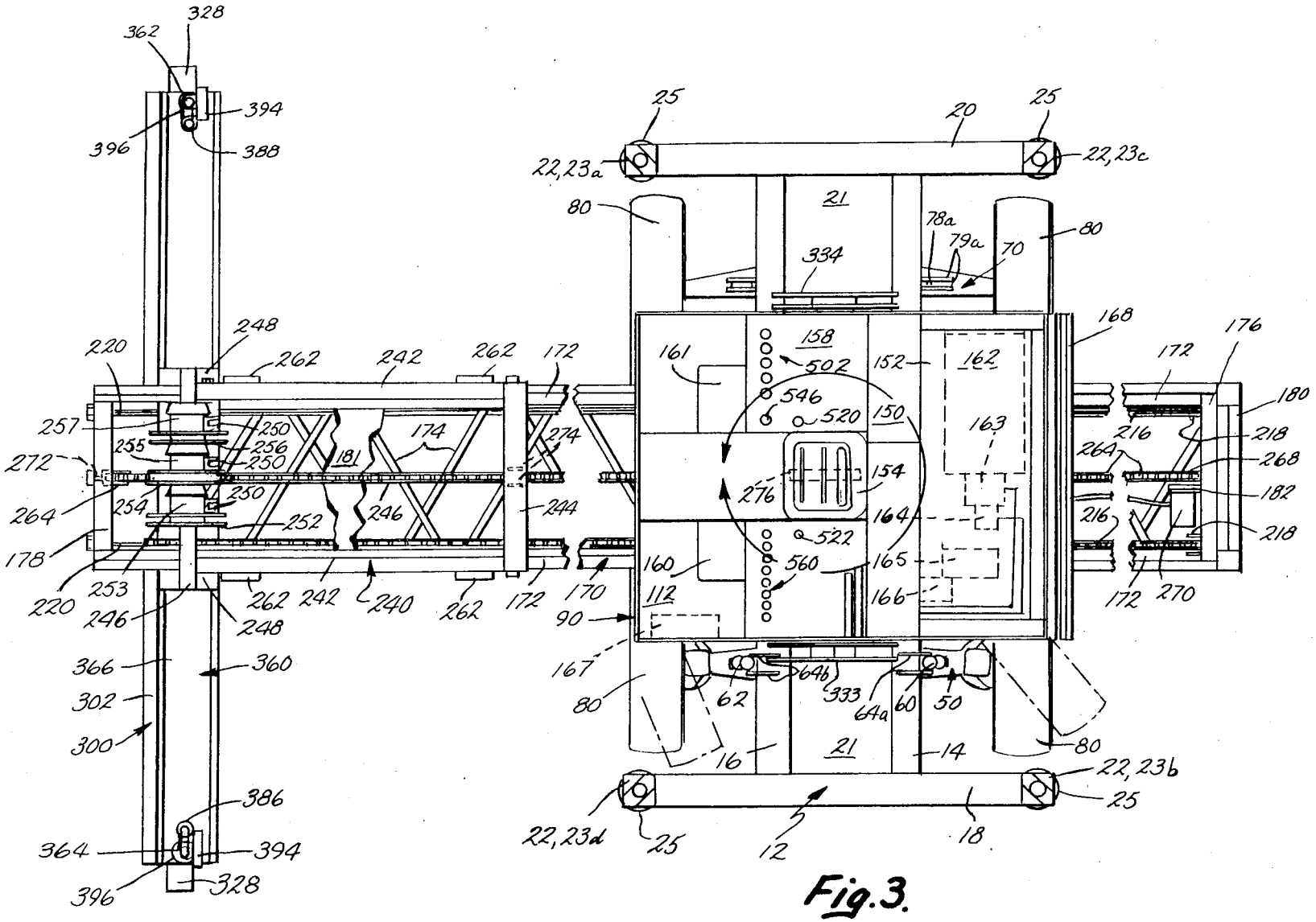
FIG. 3 is a plan view of the screeding apparatus shown in FIGS. 1 and 2.
Figure 4:
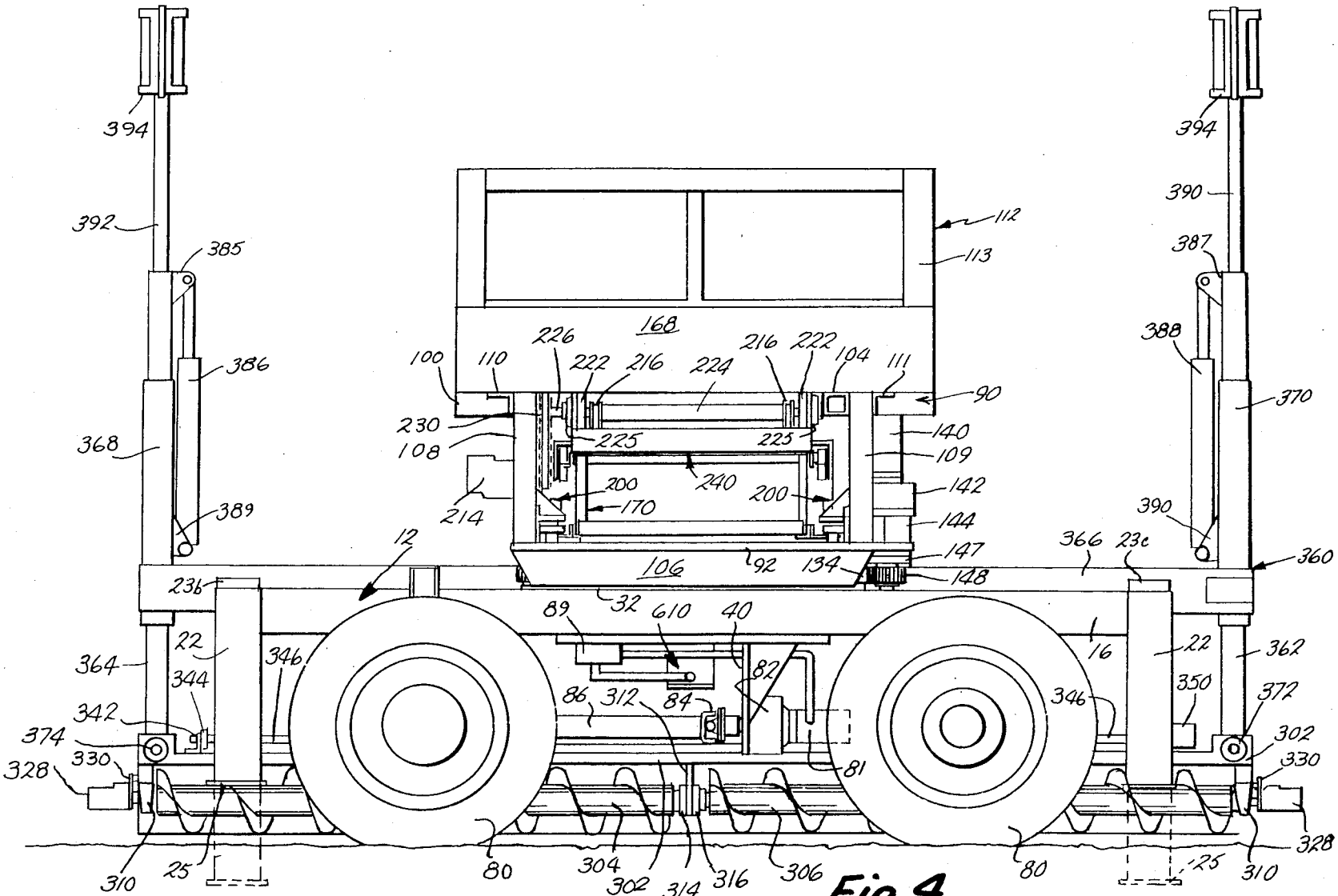
FIG. 4 is a side view of the screeding apparatus of FIGS. 1–3 showing an end elevation of the operator platform and screed support boom.
Figure 5:
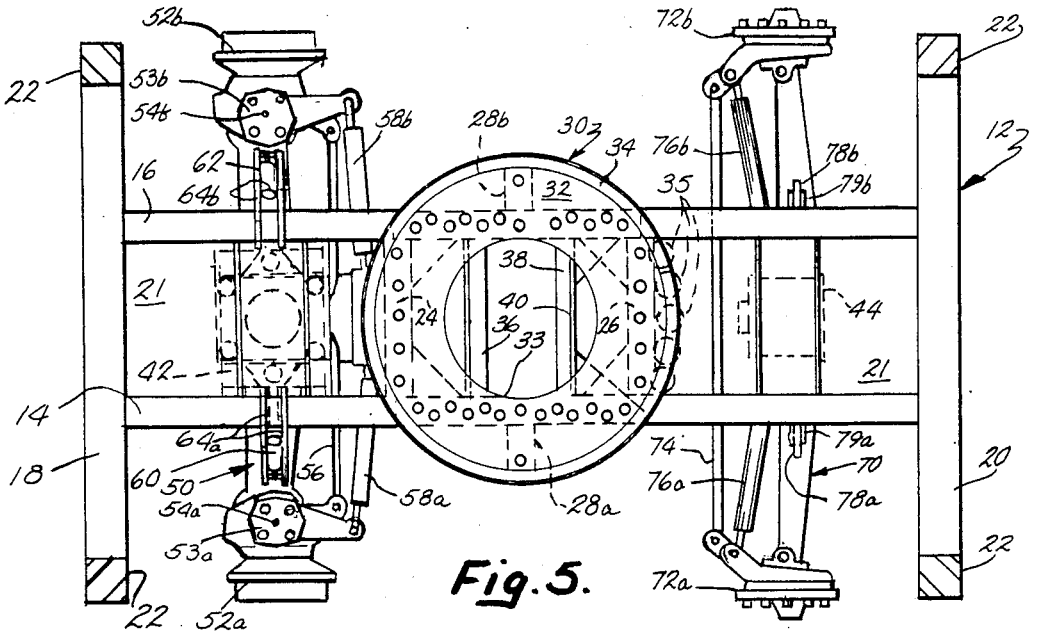
FIG. 5 is a plan view of the lower frame portion of the screeding apparatus with the propulsion support axles mounted thereon.
Figure 6:
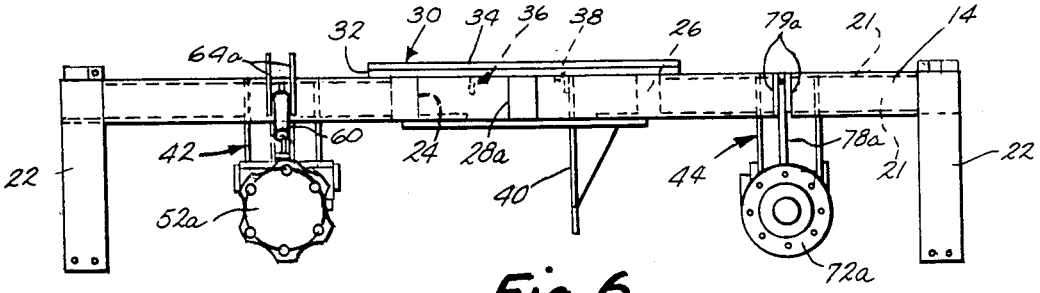
FIG. 6 is a side view of the lower frame and axle combination shown in FIG. 5.
Figure 7:
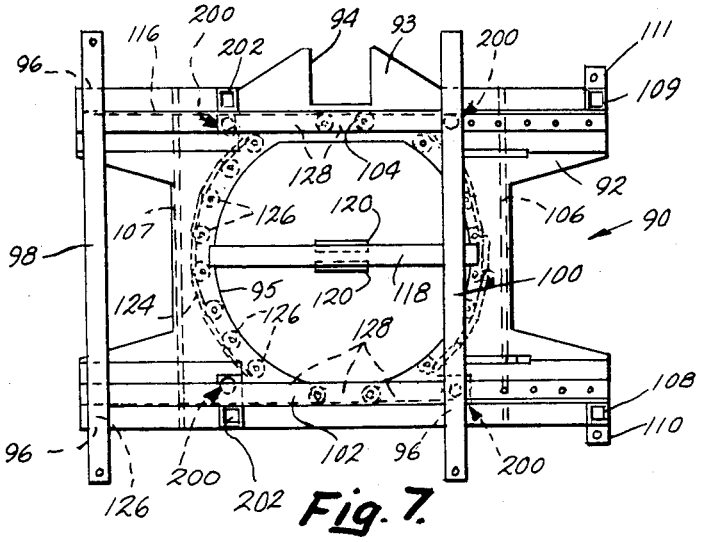
FIG. 7 is a plan view of the upper frame portion of the screeding apparatus.
Figure 8:
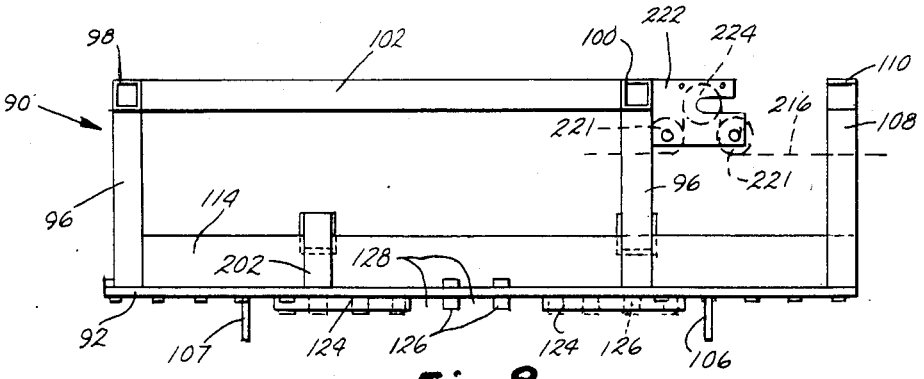
FIG. 8 is a side view of the upper frame portion shown in FIG. 7.

Referring now to FIGS. 5 and 6 in addition to FIGS. 1–4, lower support frame 12 includes a rigid framework formed from a pair of parallel, box section, tubular longitudinal steel beams or frame members 14, 16 and a pair of parallel, box section, tubular steel lateral front and rear beams or frame members 18, 20 extending across the ends of beams 14, 16. Appropriate deck plating 21 is provided flush with the top and bottom surfaces of framework beams 14, 16 as shown in FIGS. 3, 5 and 6. Stabilizer leg mounting tubes 22, one at each end of each of the lateral frame members 18, 20, extend downwardly for receipt of extendable stabilizer legs **23*a*–23*d* as explained hereinafter. A pair of laterally extending support beams 24, 26, one on either side of the center of the framework 12 extend between beams 14, 16, while a pair of short, projecting beams 28*a*, 28*b* extend outwardly from the centers of beams 14, 16. Mounted atop beams 14, 16, 24, 26, 28*a* and 28*b* is an annular support 30 for the lower, outer race of the rotational bearing 130 which supports the upper frame portion 90 including the operator platform and screed support boom as explained hereinafter. Annular support 30 includes an annular lower plate 32 plug welded to beams 14, 16 and an outer, annular bearing support 34 welded to plate 32 as shown in FIG. 6. The center of support plate 32 is removed forming circular aperture 33 between beams 14, 16 to allow mounting of the hydraulic swivel assembly 610 therethrough on laterally extending swivel support channels 36, 38 as explained hereinafter. A propulsion motor and drive shaft support plate 40 also extends downwardly from support channel 38 between beams 14, 16 as best seen in FIG. 6**.

Midway between bearing support 30 and the ends of the lower framework 12 are front and rear axle support brackets 42, 44. Brackets 42, 44 are secured between beams 14, 16 by welding or the like and project downwardly for receiving front and rear propulsion support axle assemblies 50, 70.

Front axle 50 preferably is a combined drive/steering axle assembly having a center differential axle with planetary gear reducing wheel support assemblies at its outboard ends for reducing the drive speed of the wheels. Axle 50 includes a pair of driven wheel hubs **52*a* and b (FIGS. 2, 5 and 6) which are pivotable on steering knuckles or trunions 53*a*, 53*b* about turning axes 54*a* and *b* which are offset slightly from the vertical. A tie rod 56 is connected between steering knuckles 53*a*, 53*b* such that the hubs and wheels will pivot in unison as powered by a pair of hydraulic cylinders 58*a*, 58*b*. Cylinders 58*a*, 58*b* are connected to a pressurized hydraulic system as explained hereinafter. Axle assembly 50, which is preferably a drive/steer axle sold under Model No. DS55 by Ford Motor Company, Dearborn, Mich., is pivotally mounted on support bracket 42 for pivotal oscillation about a horizontal axis 55 (FIG. 2) in a vertical plane. As illustrated, the axle may oscillate through 10 degrees both above and below the horizontal such that screeding apparatus 10** may accommodate sloped terrain while the operator platform is kept generally level.

In order to lock the drive/steer axle 50 and prevent its oscillation when a working position is reached, a pair of hydraulic, axle oscillation lock cylinders 60, 62 are pivotally mounted between pairs of support flanges **64*a*, 64*b*, welded to extend upwardly and outwardly from framework beams 14, 16 as shown in FIGS. 2, 5 and 6, and a pair of lower pivot links 66*a*, 66*b* which are pivotally mounted on either side of axle support bracket 42 (FIG. 2). When hydraulic cylinders 60, 62 are extended, the outer ends of links 66*a*, 66*b* are pressed against the top surface of axle assembly 50 on either side of pivot axis 55 to lock the axle in that position and prevent it from further oscillation until the oscillation lock cylinders are released. Accordingly, wheels 80 on front axle 50 are pivotable in unison via tie rod 56 and hydraulic cylinders 58*a*, 58*b* as controlled by the vehicle operator. The operator may also lock axle 50** in its pivoted position when an appropriate work area has been reached through hydraulic valve controls at the operator position as explained hereinafter.

In the preferred embodiment, rear support axle assembly 70 is a steering axle assembly of the type sold under Model S55 also by Ford Motor Company. Axle 70 (FIGS. 5 and 6) includes a pair of steerable wheel support hubs **72*a*, 72*b* connected for unison pivotal movement by tie rod 74 and powered by hydraulic steering cylinders 76*a*, 76*b* connected to the vehicle hydraulic system as explained hereinafter. Axle assembly 70 is rigidly mounted on rear axle support bracket 44 by a three-point connection including bracket 44 and rigid support links 78***a*, 78*b* extending from the axle to opposed pairs of flanges 79*a*, 79*b* welded to opposite sides of framework 12 on beams 14, 16 (FIGS. 3, 5 and 6). Wheel hubs 72*a*, 72*b* and thus supported wheels 80, thereon are pivoted for turning the vehicle with tie rod 74 and cylinders 76*a*, 76*b* as controlled by the vehicle operator. It will be apparent that by pivoting rear wheels 80 oppositely to front wheels 80 as shown in FIG. 3, the turning radius for apparatus 10 may be made extremely small. Thus, the ability to steer the wheels on both axles makes the apparatus extremely maneuverable into small areas such that boom 170 and screed 300 can reach a variety of areas.

As shown in FIGS. 1–6, stabilizer leg mounting tubes 22 receive downwardly extendable stabilizer hydraulic cylinders 23*a*–23*d* mounted therewithin. Each of the four extendable cylinders 23 includes a lower footplate 25 for contacting the ground surface when the stabilizer cylinders are lowered. A pair of cylinders 23 on one side of the apparatus are operable in unison with the vehicle hydraulic system, while the two remaining stabilizer cylinders on the opposite side may be lowered independently of one another, all as controlled by the operator on the operator platform 112. This allows the apparatus to accommodate variations in ground height and provides a triangular configuration when raising the vehicle to accommodate those irregularities. As explained below, the control valving for stabilizer cylinders 23 includes fluid lock valves to prevent leakage of hydraulic fluid from, and resultant undesired retraction of, those cylinders during operation of the machine in a working position.

In the preferred embodiment, a hydraulic propulsion motor 81 (FIG. 4) is mounted on motor support plate 40 with a spring loaded, pressure released "fail safe" brake 82 therebetween. The motor and brake are connected by two universal joints 84 on either end of drive shaft 86 to the rear of front axle 50. Thus, when hydraulic pressure from the vehicle hydraulic system is provided through appropriate hydraulic lines and a dual counterbalancing valve 89 (FIG. 4) to motor 81, brake 82 is released allowing drive shaft 86 to drive a differential (not shown) within axle 50 causing propulsion of machine 10 in either forward or reverse depending on the direction in which motor 81 is driven. Brake 82 is of the type sold under Model No. 30473 by Ausco Company of St. Joseph, Mich. Valve 89 retards hydraulic fluid flow to motor 81 on grades to prevent the machine from traveling downhill at too great a speed.

As an alternative to the wheel drive through axle 50 as described above, it would be possible to substitute different propulsion structures on frame 12 such as driven endless tracks as are conventionally used on bulldozers, power shovels and other heavy construction machinery. However, rubber tired wheels or even solid steel disk wheels of a thinner variety than rubber tires provide a narrower track to be filled in with concrete or other material being screeded when the apparatus is operated with the screed behind the rear wheels and driven through placed and/or poured, uncured concrete as in one operational method described below.

Referring now to FIGS. 2–4, 7 and 8, the upper framework 90 which supports operator platform 112, engine 166, the hydraulic power system controls, and boom 170, and which is adapted for rotational mounting on lower framework 12, is shown in greater detail. Upper framework 90 includes a generally H-shaped support plate 92 having an outwardly projecting rotation motor support flange 93 with a recess 94 therein on one side. Extending upwardly from plate 92 are a series of tubular steel support posts 96 across which are welded laterally extending support beams 98, 100. Longitudinal beams 102, 104 are welded between beams 98, 100 and vertical posts 96. Stiffeners 106, 107 extend laterally across the bottom of plate 92 to help provide rigidity for the upper framework. At the rear of the support platform, two additional vertical support posts 108, 109 are mounted on plate 92. L brackets 110, 111 are welded on the outer sides of posts 108, 109 and help support an operator platform floor plate which also supports the engine, fuel and hydraulic fluid tanks and other engine accessories as explained hereinafter atop posts 96, 108, 109 and beams 98, 100, 102 and 104 (FIGS. 2 and 3). Longitudinal side plates 114, 116 are welded to the inside surfaces of vertical posts 96, 108 on one side and 96, 109 on the opposite side and help support cantilevered boom 170 as explained hereinafter.

Centered within H-shaped support plate 92 is a generally circular aperture 95 spanned by a longitudinally extending beam or plate 118 including spaced rails 120 centered on the underside thereof for receiving the top of hydraulic swivel 610. Extending concentrically around the perimeter of aperture 95 are a series of vertically extending spacer strips 124 welded to cylindrical spacer bushings 126 at some 24 spaced locations around aperture 95. Spacer strips 124 are discontinued adjacent the lateral sides of plate 92 to provide spaces through which hydraulic lines may be passed from the hydraulic system components on framework 90 to the fluid swivel 610 extending between the upper and lower frame portions 90, 12 as explained below.

Figure 11A:
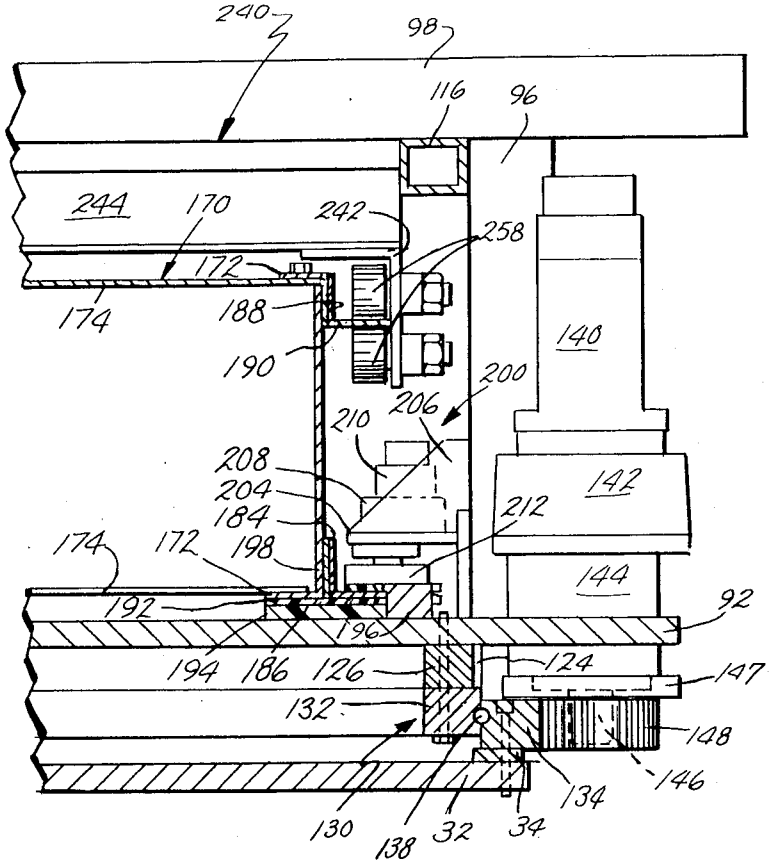
FIGS. 11 and 11*a* are sectional views taken along lines XI—XI and XIa—XIa respectively of FIG. 2 of the support structure for the cantileverd boom on the upper frame and rotational bearing between the upper and lower frame portions.
Figure 11:
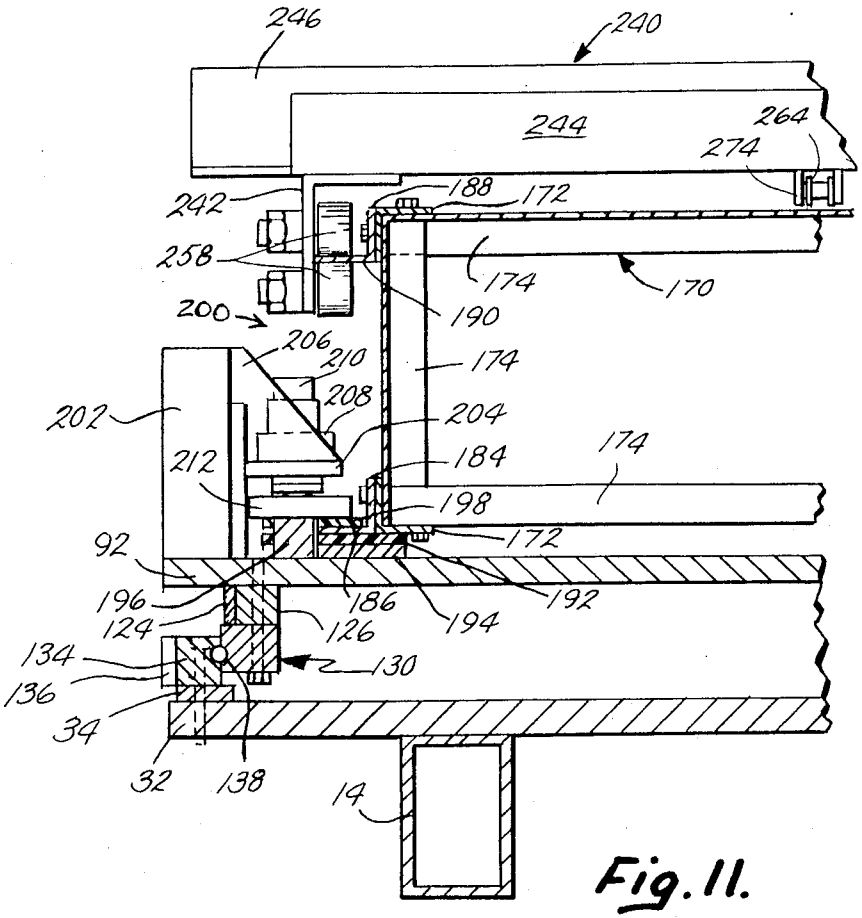

Rotational movement between the lower and upper framework portions 12, 90 is provided by a horizontal, high load capacity, swing or rotational bearing assembly 130 mounted between framework portions 12, 90. Bearing 130 is preferably of the type sold under Part No. 743A9 by Sifco Bearings, Avon, Ohio. As is best seen in FIGS. 11 and 11*a*, bearing assembly 130 includes an inner race 132, an outer race 134 having a series of drive teeth 136 formed on its outer periphery, and a series of caged ball bearings 138 in aligned raceways on the inner surface of outer race 134 and outer surface of inner race 132. Inner race 132 is bolted through spacer bushings and spacer strips 126, 124 to plate 92 and projects downwardly from the underside of upper framework 90. Outer race 134 is bolted at spaced positions through plate 32 to the upper surface of annular support pad 34 and extends upwardly from the upper surface of lower framework 12. Access holes 35 (FIG. 5) through lower deck 21 are provided for fastening the bolts for outer race 134 which extend through holes 37 in the upper deck 21 between frame members 14, 16. A hydraulic rotation motor 140 rotates upper framework 90 with respect to the lower framework 12 through 360 degrees on bearing 130. Rotation motor 140 is connected to a spring loaded, pressure release "fail safe" brake 142 like brake 82 and is mounted on an overhung load adapter 144 on flange 93 of support plate 92. Overhung load adapter 144, preferably Model 815-14S obtained from Helland Company of Plymouth, Minn., extends downwardly through aperture 94 in flange 93 and includes a shaft 146 driven by rotation motor 140 and brake 142. A spacer plate 147 is secured to the bottom of load adapter 144 while a driven pinion or gear 148, which is engaged with the teeth 136 on the exterior of outer race 134, is secured to shaft 146. Overhung load adapter 144 absorbs radial and moment loads exerted against drive pinion gear 148 during the operation of the screeding apparatus. Accordingly, when hydraulic fluid under pressure from the machine hydraulic system is applied to rotation motor 144, and brake 142 is released via its own release valve 520 (FIG. 16*a*) allowing shaft 146 to drive gear 148 such that the motor 144 and upper framework 90 are rotated about outer race 134 on inner race 132 in proportion to the rotational speed of the drive pinion.

Referring again to FIGS. 1–4, operator platform 112 includes an upstanding welded framework 113 (FIG. 2) which supports a fuel and hydraulic tank 150, an engine, engine accessory and hydraulic pump compartment 152 to the rear of tank 150, an operator's seat 154 in front of tank 150 and left and right consoles 156, 158 on either side of the operator's seat. A series of manually operated hydraulic control spool valves 502, 560 are mounted in rows on consoles 156, 158 for controlling the various apparatus operations as explained below in connection with FIGS. 15 and 16. In addition, a laser beacon elevation control system panel 160 is mounted on console 156 to the left of the operator while an engine control instrument panel 161 is located on right console 158 atop the operator platform. Mounted within engine compartment 152 are a conventional internal combustion engine 162 providing power to a pair of hydraulic pumps 163, 164 as explained below in connection with the hydraulic system, a battery 165 for starting engine 162, and operating various electrical elements and controls, and various hydraulic system components such as an unloading relief hydraulic valve 166. Beneath the forward end of the operator platform are mounted other hydraulic system components such as hydraulic pressure accumulator tank 167. Also mounted at the sides of the operator platform are a pair of spring retracted hose reels 333, 334 for storage and playing out of the hydraulic fluid lines connected to the left and right auger drive hydraulic motors 328 on screed 300 as explained below. In addition, a series of counterweights 168 are bolted on the rear of the operator platform behind engine compartment 152 to counterbalance the weight of the extending cantilever boom 170 when the apparatus is in operation. Preferably, internal combustion engine 162 is VM Model Sun 2105 available from VM Group of America, Houston, Tex., having a horsepower rating of approximately 42.5 at 2600 rpm.

Hydraulic Swivel

Figure 9:
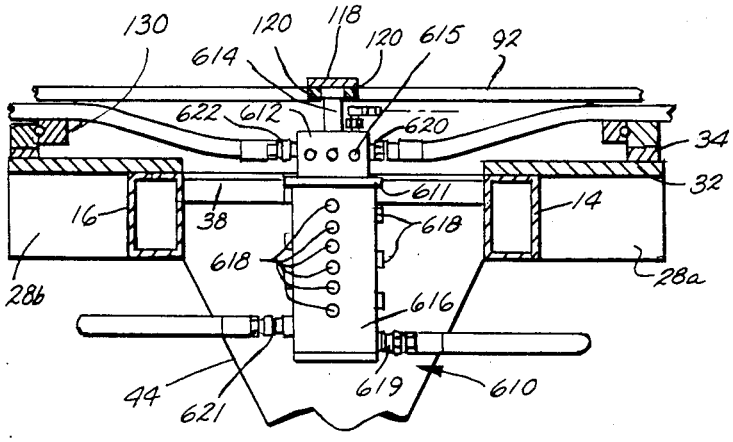
FIG. 9 is a side elevation of the hydraulic swivel extending between the upper and lower frame portions shown in FIGS. 5–8.
Figure 10:
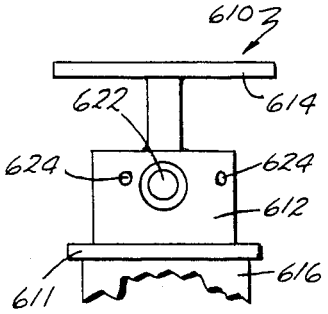
FIG. 10 is a side elevation of the upper portion of the hydraulic swivel shown in FIG. 9.

As shown in FIGS. 9 and 10, a rotatable hydraulic swivel assembly 610 is bolted via mounting flange 611 on support beams 36, 38 and projects downwardly below main lower frame beams 14, 16 and upwardly through the aperture 33 in bearing support plate 32. Fluid swivel 610 includes an inner, cylindrical spool or sleeve 612 including a T-shaped key or projection 614 extending upwardly therefrom for engagement between guide members 120 and against the underside of beam 118 such that the projection 614 and spool 612 rotate with upper framework 90. An outer sleeve 616 surrounds spool 612 and includes 14 ports 618 spaced therealong and therearound which communicate with individual passageways bored through spool 612 from various inlet port locations on the spool. For instance, two major inlet ports 620, 622 are connected to the sides of cylindrical spool 612 while a series of smaller diameter inlet ports 615, also spaced around the side of cylindrical spool 612 or on its top surface, each communicate with a corresponding single outlet port 618 on the lower, outer sleeve 616. Major inlet port 620 is connected to input hydraulic lines 500 and 543 (FIG. 16) for propulsion motor 81 and communicates with outlet port 619 while major inlet port 622 is connected to hydraulic line 552 which returns from motor 81 and communicates with major port 621 for returning fluid to tank 150 from the propulsion motor. Thus, fluid communication between the rotating upper framework where the internal combustion engine 162 and hydraulic pumps 163, 164 are located and the stationary lower framework 12 where numerous fluid motors or connections to fluid motors are made is provided.

Boom Support and Screed Trolley Assembly

As is best seen in FIGS. 1–4, 11 and 11*a*, boom 170 is mounted for horizontal extension and retraction on the upper framework 90 below operator platform 112 such that it extends from either side of the platform below the counterweight 168. Boom 170 is a rectilinear beam assembled from four steel angle, longitudinal beam members 172 at the four corners of the boom connected by a plurality of boom truss members or struts 174 extending diagonally between corner channels 172 on the vertical sides and along the horizontal top and bottom of the boom. At the top of either end of the boom are square tube cross struts 176, 178 for securing the top longitudinally extending boom members 172 together, while angle cross struts 180 extend across the boom at either end between the lower boom members 172. The beam assembly is preferably covered or boxed in with aluminum or other plates 181 (FIG. 3) for increased torsional rigidity. A hydraulic motor mounting plate 182 (FIGS. 2 and 3) extends forwardly from cross strut 176 at the rear end of boom 170 for mounting the trolley drive motor as explained hereinafter. Along the bottom corners of the boom assembly are bolted longitudinally extending angle members 184 having horizontally outwardly extending flanges 186 forming mounts for sliding the entire boom within the upper framework 90. Pairs of angle members 188 having horizontally outwardly extending flanges 190 are mounted at the top corners of the boom assembly (FIGS. 11 and 11*a*). Flanges 190 form a horizontal support for the bearing members which movably mount the screed support trolley 240 for axial movement along the length of the extending boom 170 during screeding operations as explained hereinafter.

As is best seen in FIGS. 4, 7, 8, 11 and 11*a*, boom assembly 170 is slidably supported atop a pair of ultra high molecular weight, polyethylene bearing strips 192 which rest atop bearing pads 194 and include apertures through their outer edges for receiving retaining posts 196 at spaced locations adjacent the edge of bearing pads 194 on either side of the boom assembly (FIGS. 11 and 11*a*). A second ultra high molecular weight, polyethylene bearing strip 198 is mounted atop flanges 186 on either side of the boom assembly also including apertures telescoped over retaining posts 196.

In order to prvent the sliding boom assembly from lifting or tipping off lower bearing pads 192 when extended to its maximum position outwardly as shown in FIG. 2, a series of four clamping assemblies 200 are secured to vertical upper frame posts 96 and clamp assembly posts 202 at spaced locations on the upper framework as shown in FIGS. 2, 7, 8 and 11. Each clamp assembly 200 is mounted on a support plate 204 secured by a diagonal gusset 206 from posts 202 or 96. Support plates 204 include apertures extending therethrough over which are mounted blocks 208 having threaded apertures extending therethrough for receiving externally threaded hydraulically operated, clamping cylinders 210 which extend through blocks 208 and plate 204 above upper bearing pads 198. A clamping block 212 is secured to the lower end of clamping cylinders 210 for engagement with the upper surface of bearing pad 198 between retaining posts 196. When an appropriate control valve as described below is opened, hydraulic pressure is applied to clamping cylinders 210, forcing clamping blocks 212 and bearing pads 198 downwardly to securely clamp flanges 186 from the boom assembly. Thus, when boom assembly 170 is extended to the desired position, the four clamping cylinders 210 are activated to secure the boom in place and prevent its movement while the screeding operation takes place.

Extension and retraction of boom assembly 170 on bearing pads 192, 198 is provided by a chain drive operated by boom drive motor 214 mounted on upper framework 90 as shown in FIGS. 2, 3, 4 and 8. Boom assembly 170 includes a pair of longitudinally extending drive chains 216 (FIG. 3) immediately inboard of each upper corner boom member 172. Drive chains 216 are fixed at the rear end of the boom in brackets 218, while tension adjusting bolts 220 are provided at the forward end of the boom for each chain 216. Chains 216 each extend through a pair of idler sprockets 221 (FIG. 8) mounted on boom drive support plates 222 extending rearwardly from cross beam 100 on either side of upper framework 90. Idler pulleys 221 direct chains 216 around sprockets mounted on a laterally extending boom drive cross shaft 224 (FIGS. 4 and 8) which extends between boom drive mounting plates 222. Shaft 224 is suitably mounted in bearing pillow blocks 225 secured to mounting plates 222 and has one extending end 226 which receives a drive sprocket 228. An endless drive chain 230, which is looped around a drive sprocket on the drive shaft of boom drive motor 214 (FIGS. 2 and 4), rotates the entire cross shaft 224 and the included sprockets to pull the drive chains 216 and the entire boom assembly 170 to which they are attached in one direction or the other depending on the rotational direction of motor 214. Accordingly, as hydraulically powered boom drive motor 214 is operated, cross shaft 224 is driven to extend or retract the boom assembly as desired following which boom clamp cylinders 210 are activated to hold the boom assembly in place as mentioned above.

Once the screeding vehicle 10 has been positioned either adjacent a section of placed and/or poured concrete or within an area of placed and/or poured concrete, and the upper framework is rotated to the desired position for extension of boom 170, the screed assembly 300, the screed support and elevation assembly 360, and trolley support 240 for the screeding assembly are operated. Support for movement of the screed assembly 300 and elevation assembly 360 along the length of the extended cantilever boom 170 is provided by trolley assembly 240 best seen in FIGS. 2, 3, 4, 11 and 11*a*. Screed support trolley 240 is an elongated framework including longitudinally extending side members 242 connected at their inner end by cross channel 244 and at their outer end by cross member 246. Cross member 246 is longer than the width of the remainder of the trolley framework such that a longer support foot 248 is suspended below the trolley at its forward end. Screed elevation assembly 360 is bolted or welded to foot 248. Extending upwardly from the cross member 246 at the forward end of the trolley are a series of three vertical channels 250 (FIG. 3) upon which are mounted a series of three spring biased hydraulic hose reels 252, 254 and 256 each having a hub 253, 255 and 257 respectively including a rewind spring of conventional nature. Outside hose reels 252 and 256 store the hydraulic hose for the left and right screed elevation hydraulic cylinders 386, 388 as explained below while inner reel 254 stores hydraulic hose for the screed head vibration drive motor 350 as explained below. As shown in FIG. 1, a hood or cover can be included over reels 252, 254, 256 for protection if desired.

Trolley framework 240 is movably supported on horizontally extending flanges 190 of boom assembly 170 with four pairs of vertically oriented trolley support casters or cam followers 258 (FIGS. 11 and 11*a*) mounted on horizontal axes at the front and rear of the trolley. Lateral positioning of the trolley is maintained by two pair of horizontal cam followers or casters 260 also at the front and rear of the trolley. Cam followers 260 engage the outer edge of channel flanges 190 on the boom assembly. Casters or cam followers 260 have vertical axes of rotation and are mounted on outwardly extending support flanges 262 extending outwardly from trolley side members 242. The trolley framework 240 may thus roll along the entire length of the cantilevered rectilinear boom assembly 170 toward and away from the operator platform 112 and supporting framework to move the screed assembly 300 and screed elevation assembly 360 toward and away from that supporting framework as described below.

Trolley 240 is moved by a second chain drive assembly best seen in FIGS. 2, 3 and 11. An endless drive chain 264 extends longitudinally along the top center of the boom assembly 170 between an idler sprocket 266 at the forward end of the boom and a drive sprocket 268 mounted on the drive shaft of a hydraulic trolley drive motor 270 secured to mounting plate 182 (FIG. 3) at the rear end of the boom. Idler sprocket 264 is rotatably mounted on a chain adjustment yoke 272 at the forward end of boom 270 such that the tension on chain 264 can be appropriately adjusted. Trolley 240 is secured to drive chain 264 by means of downwardly extending flanges 274 on the undersides of cross member 244 (FIGS. 3 and 11). Accordingly, when movement of the trolley 240, screed assembly 300, and screed elevation assembly 360 is desired, the operator opens a control valve allowing hydraulic fluid under pressure to drive trolley motor 270 thereby rotating endless drive chain 264 at a controlled rate either clockwise to move trolley 240 toward the supporting framework on boom 170 or counterclockwise to move the trolley away from the framework and return the screed assembly 300 to the end of the cantilever boom.

Since trolley drive motor 270 moves with boom assembly 170 when the boom is extended and retracted, a hose reel for storage and extension of the hydraulic line leading to the trolley drive motor 270 is provided under the operator platform beneath the operator seat (FIG. 3).

Screed Assembly and Screed Elevation Assembly and Control System

As shown in FIGS. 1–4 and 12–14, screed assembly 300 is mounted on trolley 240 for movement along the length of boom 170 to distribute, spread, smooth and/or level the material adjacent the screeding machine 10 either when the vehicle is stopped in a predetermined work position adjacent an area of material or when the vehicle is driven through the material and the material is distributed, smoothed and leveled behind the rear wheels of the vehicle. Screed assembly 300 includes an elongated, generally L-shaped beam 302 including a pair of rotatable augers 304, 306 mounted within the beam, a strike-off member 335 and a screed vibration assembly 340 mounted atop the beam.

Figure 14:
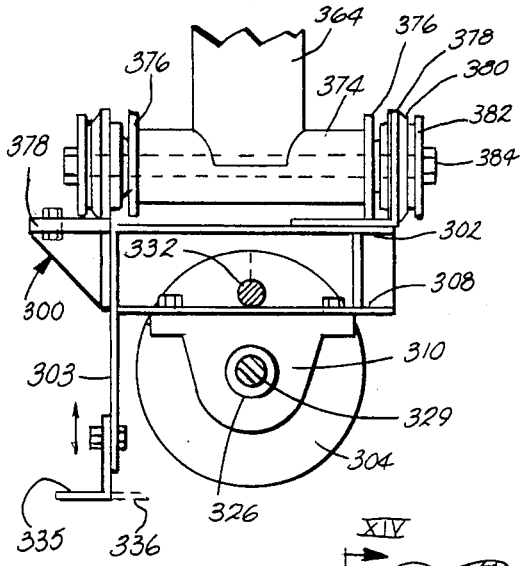
FIG. 14 is a sectional end view of the screed support shown in FIGS. 12 and 13.
Figure 13:
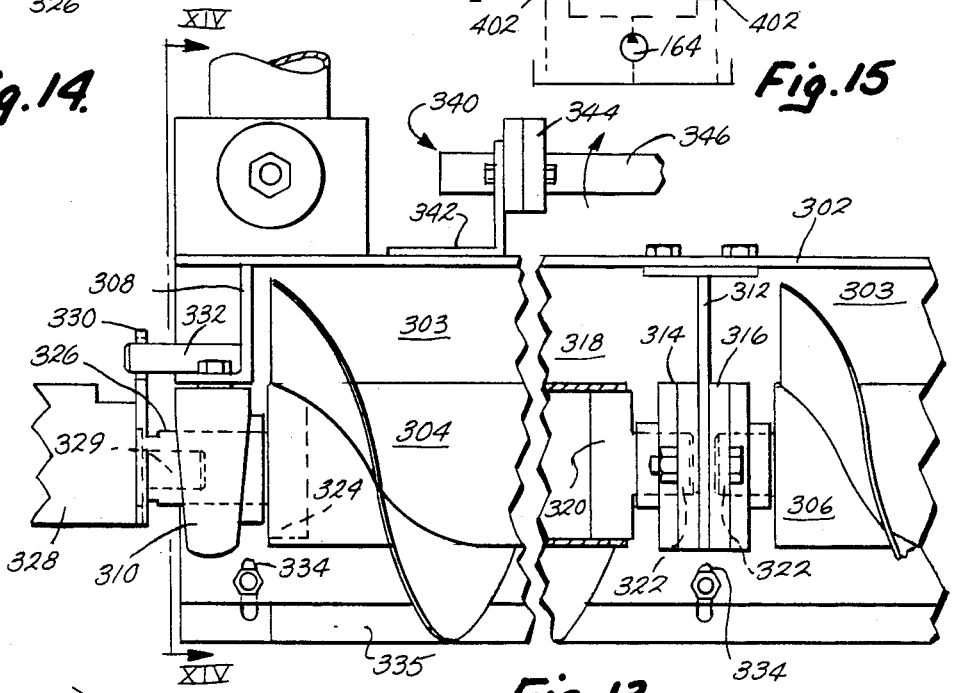
FIG. 13 is a broken, sectional side elevation of the screed support and augers shown in FIG. 12.

As is best seen in FIGS. 4, 13 and 14, beam 302 includes downwardly extending flanges 308 at either end from which are suspended flanged bearing pillow blocks 310 therebeneath by bolts or the like. Centrally located within beam 302 is a downwardly extending central mounting plate 312 for supporting the inner ends of augers 304, 306. Mounting plate 312 includes flanged bearing pillow blocks 314, 316 bolted on either side surface thereof. Each auger 304, 306 includes a cylindrical, tubular hub 318 in which are welded end disks 320 having solid extending stub shafts 322 at the inner ends of the augers, and end disks 324 having hollow extending stub shafts 326 at the outer ends of the augers. A drive shaft 329 from each of a pair of hydraulic auger drive motors 328 at either end of beam 302 is inserted within the hollow stub shaft 326 of each auger 304, 306 for rotating the augers. Drive shafts 329 include radially extending flanges or projections 330 which engage projecting studs 332 mounted on flanges 308 such that when the hydraulic motor 328 is operated through appropriate hydraulic lines and valving as explained below, drive shaft 329 and the respective auger to which it is attached is rotated while flange 330 prevents the motor 328 itself from rotating by engagement with stub shaft 332. No separate support for the hydraulic motors 328 is necessary other than extending stub shafts 326 and the rotation preventing flange 330.

Augers 304, 306 may be rotated oppositely of one another in one direction to pull and distribute placed and/or poured concrete toward the center of the beam 302, rotated oppositely of one another in the opposite direction to move the concrete outwardly toward the ends of beam 302, or rotated in the same direction to move the placed and/or poured concrete laterally toward one end of the beam or the other. Auger drive motors 328 are operated through appropriate hydraulic lines which are stored on spring return hose reels 333, 334 mounted on either side of operator platform 112 as shown in FIGS. 2 and 3.

The outer side flange 303 of screed support beam 302 extends downwardly behind augers 304, 306 and includes an L-shaped striker plate or strike-off member 335 having its lower flange extending rearwardly. The corner of strike-off member 335 engages the placed and/or poured concrete which has been spread, distributed and roughly leveled by the operation of augers 304, 306. Member 335 is adjustably mounted on flange 303 of beam 302 via elongated apertures 334 (FIG. 13) and appropriate bolts or other fasteners extending through flange 303. The height of strike-off member 335 may be carefully adjusted for cooperation with the operation of augers 304, 306. If desired, strike-off member 335 may include a forwardly extending flange 336 (FIG. 13) welded or otherwise mounted thereon to cut through and prevent the buildup of placed and/or poured concrete ahead of member 335 during screeding operations. It is preferred that forwardly extending flange 336, if included, have a rearwardly slanted forward edge to help cut through the material being screeded. Also, depending on the type of material being screeded, the position of bearings 310 may be changed to increase the space between flange 303 and augers 304, 306 to accommodate gravel, asphalt or other materials.

Figure 12:
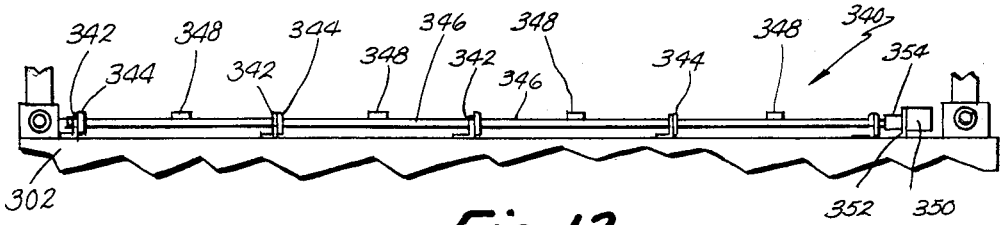
FIG. 12 is a side elevation of the screed support and screed vibration assembly of the present invention.

As shown in FIGS. 1, 12 and 14, a screed vibration assembly 340 is mounted atop screed support beam 302 for imparting vibratory motion to the entire screed assembly 300 for smoothing and finishing the concrete when contacted by strike-off 335. Screed vibration assembly 340 includes five L-shaped angle supports 342 bolted or welded atop beam 302. The vertically extending flanges of supports 342 include apertures therethrough and support flanged bearing pillow blocks 344 through which is extended a continuous vibration rod 346 rotatable in pillow blocks 344. A series of four eccentrically mounted weights 348 are bolted or otherwise secured to rod 346 at spaced locations between support flanges 342 as shown in FIG. 12. Rod 346 is rotated by a hydraulic vibration drive motor 350 mounted on a sixth support flange 352 atop beam 302 and connected to rod 346 via a flexible coupling 354 of the type sold under Model No. L-095 by Lovejoy Company of Downers Grove, Ill. When hydraulic fluid under pressure is applied to drive motor 350, coupling 354 and rod 346 are rotated at high speed such that the eccentrically located weights 348 cause the entire screed assembly including augers 304, 306 and the screeding strike-off member 335 to vibrate at a predetermined frequency. Appropriate pivot mounting supports for screed assembly 300 on elevation tubes 362, 364 are provided as described below such that the vibration essentially occurs in the axial direction of cantilever boom 170 transverse to the length of beam 302 more so than it does vertically. The vibratory motion significantly helps the smoothing and leveling of the screeding operation.

As is best seen in FIGS. 1–4 and 15, screed assembly 300 is mounted on and controlled for elevation on a screed elevation control assembly 360. Elevation assembly 360 includes a rectilinear beam 366 bolted or welded to support foot 248 on trolley 240 such that beam 366 extends perpendicular to the axial extent of cantilever boom 170. Beam 366 includes vertically extending cylindrical tubes 368, 370 on either end through which are slidably mounted inner screed elevation tubes 362, 364 on bearings pressed inside tubes 368, 370. The lower end of each inner elevation tube 362, 364 includes a horizontally extending pivot foot 372, 374 (FIG.14) having circular end disks 376 welded thereon. Feet 372, 374 provide a pivotal mounting to the top surface of screed support beam 302 by means of a pair of aligned L-shaped support flanges 378 having apertures extending through their vertically extending flanges.

In order to allow pivotal movement of the screed head with respect to the horizontal yet prevent, as much as possible, the transmission of the vibratory motion of the screed assembly to the elevation tubes, boom 170 and the laser control system, each foot 372, 374 is mounted on support flanges 378 by means of a pair of rubber tube form mounts 380 such as those sold under the STA series by Lord Company of Erie, Pa. Tube form mounts 380 extend through the apertured vertical flanges of support mounts 378 and bear against end disks 376 on feet 372, 374 and are held in place by washers 382 and a bolt 384 extending through the washers, tube form mounts, support flanges and feet 372, 374 as shown in FIG. 14. Rubber tube form mounts 380 are substantially flexible in the axial direction of bolt 384 but substantially inflexible in the radial direction. Accordingly, screed assembly 300 is allowed to vibrate forwardly and rearwardly with respect to boom 170 without transmitting substantial vibration upwardly along elevation tubes 362, 364 all while allowing the ends of the screed support beam 302 to be pivoted with respect to the elevation tubes such that various slopes and ground contours can be accommodated by the screeding apparatus.

Figure 15:
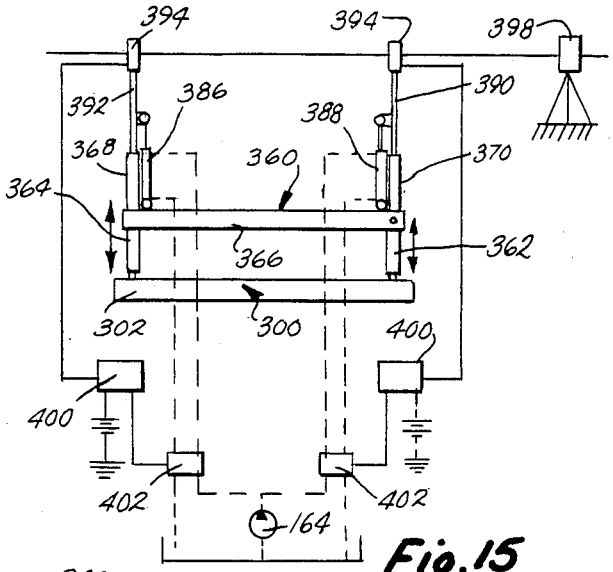
FIG. 15 is a schematic view of the laser beacon screed elevation control system for the screed assembly.

In order to raise and lower the screed assemby 300 shown in FIGS. 2 and 15, each elevation tube 362, 364 is vertically movable by means of an extendable hydraulic cylinder 386, 388 pivotally mounted between flanges 385, 387 extending inwardly from the upper ends of inner screed elevation tubes 362, 364 and flanges 389, 390 extending inwardly from the exterior of vertically extending outer tubes 368, 370 immediately above screed elevation beam 366. When hydraulic fluid pressure is applied to cylinders 386, 388, the pistons are extended raising tubes 362, 364 along with screed assembly 300. If slanting of the screed assembly 300 is desired, one or the other of the tubes may be raised via cylinders 386, 388 without movement of the other. As explained below, such elevation is typically controlled automatically through a laser beacon reference control system, although manual overriding of such system can be accomplished through operator controlled valving on the operator platform 112 to raise and/or lower screed assembly 300 at a different pace.

As will be understood from FIG. 15, as well as the hydraulic system explained below, the laser beacon reference plane control system for automatically controlling the elevation of screed assembly 300 by means of elevation tubes 362, 364 includes a pair of laser receiver mounting masts 390, 392 extending vertically upwardly from elevation tubes 362, 364. A laser beacon receiver 394 is removably secured to each mast by a screw-type clamp 396 (FIG. 3). Each laser beacon receiver is preferably of the type sold under Model No. R2S or R2N by Spectraphysics Construction & Agricultural Division of Dayton, Ohio. Receivers 394 are 360 degree omni-directional receivers which detect the position of a laser reference plane such as that provided by a long range rotating laser beacon projector 398 preferably of the type sold under Model No. 1044-L also by Spectraphysics of Dayton, Ohio. The rotating laser beacon reference plane generated by projector 398 is received and detected by laser receivers 394 which then generate electrical signals transmitted through appropriate electrical connections as shown in FIG. 15 to laser control boxes 400, one being provided for each elevation tube and hydraulic cylinders 386, 388. Control boxes 400 are preferably of the type sold under Model No. CB20TO also by Spectraphysics. Control boxes 400 receive and process the signals from laser receivers 394 and transmit electrical signals to laser controlled, solenoid operated hydraulic valves 402 which are connected by appropriate hydraulic lines to the hydraulic cylinders 386, 388. Accordingly, when hydraulic pressure from a hydraulic pump 164 is applied to solenoid valves 402, and valves 402 allow pressure to cylinders 386, 388 as controlled by electronic control boxes 400, cylinders 386, 388 raise or lower screed assembly 300 in relation and reference to the laser beacon reference plane provided by projector 398 which is located off the screeding apparatus 10 at an adjacent, fixed position near the construction site. Control boxes 400 provide proportional time valve outputs for driving the solenoid valves 402 and automatic elevation control when the changes in elevation of the screed assembly 300 are minimal, but allow manual override and gross adjustment in the screed assembly elevation by the machine operator when desired. Accordingly, regardless of whether the screeding operation takes place with the machine in a fixed position with trolley 240 being drawn inwardly toward the machine for screeding concrete adjacent the machine, or whether the machine is driven through freshly placed and/or poured concrete with the boom rotated to a position behind the vehicle and the screed assembly fixed at a position behind the rear wheels 80 on boom 170, automatic elevation control of the screed assembly 300 will take place via the laser beacon reference control system in the manner described above.

Alternative Embodiments

Figure 17:
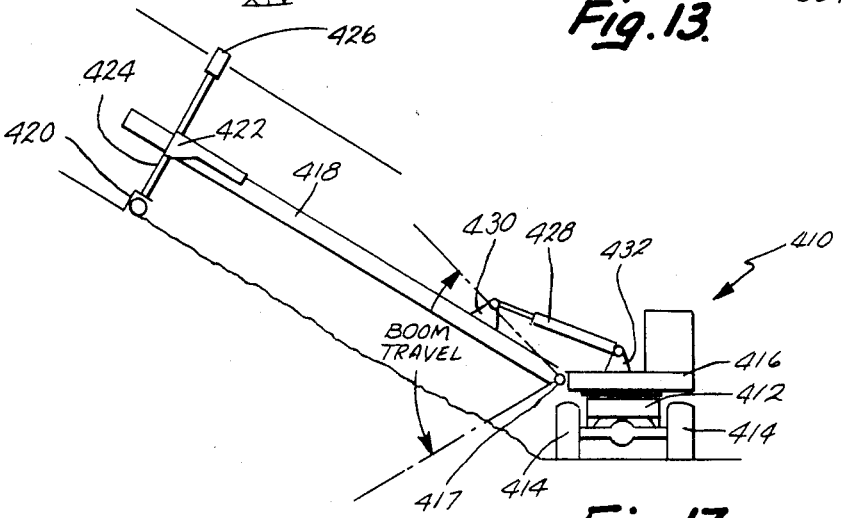
FIG. 17 is a side view of an alternate form of the screeding apparatus.

As shown in FIG. 17, an alternative embodiment 410 of the screeding apparatus or machine is shown including a cantilevered boom which may be pivoted vertically for screeding slopes or other irregular surfaces adjacent the position of the screeding vehicle. Apparatus 410 includes a lower frame 412 mounted on four rubber tires 414 for transporting the vehicle to an appropriate work place. An upper framework 416 is mounted for 360 degree rotation with respect to lower frame 412 on a suitable horizontal bearing such as that described above at 130. At one side of the rotatable upper framework 416 is pivotally mounted a cantilevered boom 418 of the type generally described at 170 above but being mounted on a horizontal pivot axis 417 such that the boom is vertically movable as shown in FIG. 17. As with embodiment 10 of the apparatus, a screed assembly 420 like assembly 300 is mounted for movement along boom 418 on trolley 422 and mounted for elevation control on extendable elevation tubes 424 via laser beacon reference plane control system 426 is included such that screed assembly 420 can be drawn toward the framework for screeding placed and/or poured concrete or other materials on a sloped surface. In order to accomplish the sloped or inclined screeding, however, the boom 418 is pivoted to the appropriate angle parallel to the slope with a hydraulic cylinder 428 pivotally mounted between flanges 430 on boom 418 and flanges 432 on the upper rotatable framework 416. Hence, in this version of the machine, the apparatus may be positioned adjacent a slope with the boom positioned parallel to the incline of the slope after which prepoured concrete along the slope can be spread, distributed, smoothed and/or leveled with screed assembly 420 as moved on trolley 422 along the boom in the manner described for embodiment 10.

A further alternative embodiment 440 of the screeding apparatus is shown in FIG. 18. Embodiment 440 is a smaller version of the screeding apparatus including a fixed, rearwardly extending boom 444. Apparatus 440 allows screeding of placed and/or poured concrete behind the rear wheels of the vehicle as the apparatus is driven directly through the uncured concrete ahead of the screeding assembly. Thus, a tractor or other small four wheeled vehicle, preferably of the type operated by a single operator and having four rubber or steel tires in an appropriate propulsion system, includes a fixed, cantilevered support boom 444 extending rearwardly from the frame of the vehicle behind the rear wheels. A screed assembly 446 like assembly 300 is secured at the end of boom 444 such that the concrete behind the rear wheels of the vehicle is contacted, smoothed, distributed and leveled while any tracks made by the wheels of the vehicle during the operation are filled in. A pair of deflectors 445, one on either side of the vehicle, positioned immediately behind the rear wheels, and angled to push concrete into the wheel tracks, may be included to help fill the tracks.

although screed assembly 446 is not longitudinally movable along boom 444, its elevation is controlled with respect to the boom by means of an elevation control system similar to that described above with respect to apparatus 10. In this case, a pair of hydraulic cylinders 448, connected to an appropriate hydraulic system 450 in the vehicle 442, raise and lower screed assembly 446 as controlled by a laser beacon reference plane control system including laser beacon reference plane receivers 452 like receivers 394 described above for apparatus 10. Hence, in apparatus 440, various sized areas of placed and/or poured, uncured concrete can be screeded, smoothed and finished by driving the vehicle through the areas while screeding takes place behind the rear wheels of the vehicle on fixed boom 444 via screeding assembly 446.

It is also apparent that apparatus 10 can be operated in the same manner as apparatus 440 by rotating upper framework 90 such that cantilevered boom 170 extends rearwardly behind wheels 80 and trolley 240 is fixed in a single position on boom 170 behind those wheels. The screed assembly elevation control system is then operated to vary the elevation of the screeding assembly 300 to properly smooth and finish the concrete behind the wheels of the apparatus 10 as it is propelled directly through the uncured concrete ahead of the screeding assembly.

Hydraulic System and Operation

Figure 16:
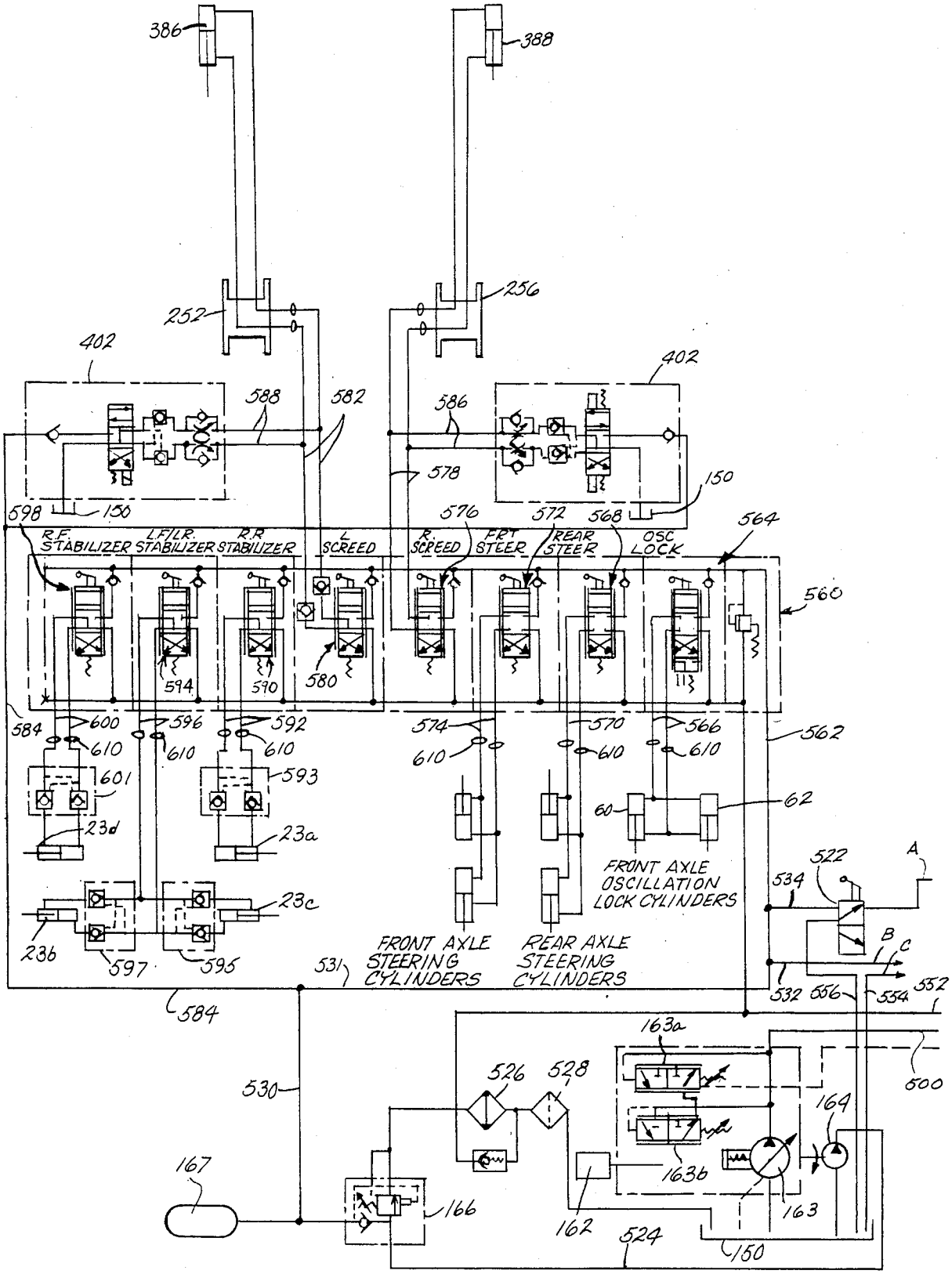
FIG. 16 is a schematic drawing of a part of the hydraulic system for operating the screeding apparatus of the present invention.
Figure 16A:
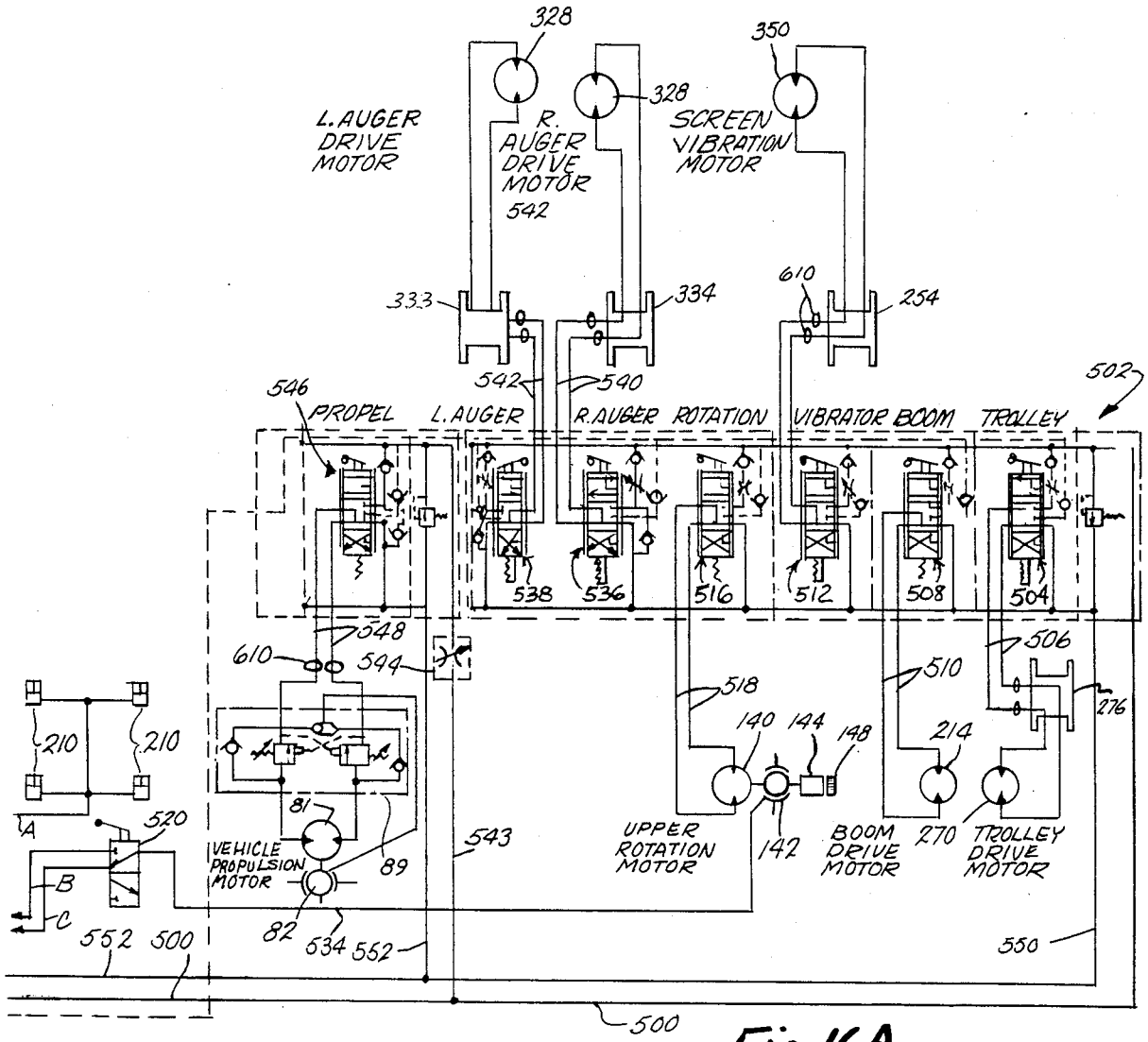
FIG. 16*a* is a schematic drawing of the remainder of the hydraulic system.

Referring now to FIGS. 16 and 16*a*, the preferred embodiment 10 of the screeding apparatus or vehicle of the present invention includes an open loop, closed center hydraulic system for operating all of the fluid motors and fluid cylinders on the various parts of the machine. A pair of hydraulic pumps 163, 164 are provided powered by a diesel or gasoline powered internal combustion engine 162. Pumps 163, 164 draw hydraulic fluid from an open, unpressurized reservoir or tank 150 located on the operator platform 112. Pump 163 includes load sensing valve 163*a* and pressure compensator valve 163*b* coupled to valve bank 502 as well as valve 546 described below to sense the amount and pressure of hydraulic fluid required. This increases pump efficiency by allowing a supply of hydraulic fluid at a pressure approximately 200 psi greater than operational requirements. Thus, the pump need not work at maximum capacity at all times. Pump 163 is a pressure and load compensated, axial piston, open loop pump of the type sold by Sunstrand Corporation of Ames, Iowa under Model L-38. Pump 164 is a fixed displacement gear pump of the type sold under Model TFM100 also by Sunstrand Corporation.

Referring first to the operations controlled and powered by main hydraulic pump 163, pump 163 feeds hydraulic fluid under pressure through hydraulic line 500 to a bank or series of hydraulic control valves 502 located on the operator platform on console 158. Control valves 502 include a series of individual, three position spool valves which may be shifted to open, close or reverse the hydraulic fluid flow through the appropriate motor or cylinder via a manually controlled handle. Each of these valves includes a flow control valve which may be adjusted open or closed to vary the speed of hydraulic fluid flow through the valve to control the speed of operation of the respective mechanism.

The first control valve 504 in series 502 controls the trolley drive motor 270 through hydraulic lines 506 which lead through swivel connections on spring biased hose reel 276 under the operator's seat 154 on the operator platform. As described above, trolley drive motor 270 rolls trolley 240 toward and away from the supporting framework on boom 170 at a rate of speed controlled by the fluid flow through valve 504 when opened manually.

The second manually controlled valve 508 in series 502 controls the boom drive motor 214 through hydraulic lines 510. When opened or reversed, valve 508 allows fluid flow to boom drive motor 214 to extend or retract boom 170 with respect to framework 90 as described.

Manual control valve 512 operates screed vibration motor 350 through hydraulic lines 514 which extend through swivel connections on spring biased hose reel 254 on trolley 240 where the lines are stored for extension. When opened, valve 512 rotates motor 350 at high speed to cause vibration of the screeding assembly to help smooth and distribute the placed and/or poured, uncured concrete or other material being finished.

A fourth manual control valve 516 controls clockwise and counterclockwise rotation of the upper framework 90 including the boom, trolley and screed apparatus through hydraulic lines 518 leading to upper rotation motor 140. However, before upper rotation motor 140 can operate drive pinion 148 through overhung load adapter 144, another two position manually controlled hydraulic fluid spool valve 520 must be manually opened to release brake 142 to allow the rotation of the upper framework with motor 140. Similarly, before and after any movement of boom 170 with manual valve 508 and boom drive motor 214, a two position manually controlled hydraulic fluid spool valve 522 must be opened to release clamp cylinders 210 to allow boom 170 to slide on its bearing pads as described above.

Both fluid brake 142 and clamping cylinders 210 are powered by hydraulic fluid under pressure from the second hydraulic pump 164 which feeds hydraulic fluid through hydraulic line 524 to unloading relief valve 166 which diverts hydraulic fluid to accumulator tank 167 until a predetermined pressure, preferably 2500 psi, is reached. Accumulator tank 167 contains a precharge of nitrogen which is compressed by the insertion of hydraulic fluid therein by pump 164 until the predetermined pressure is reached. After the accumulator tank 167 reaches 2500 psi or another predetermined charge pressure, valve 166 diverts flow back to the hydraulic tank 150 through hydraulic oil cooler 526 and oil filter 528 until further charging of tank 167 is required. Operation of valves 520 or 522 causes release of hydraulic fluid under pressure from tank 167 through hydraulic lines 530, 531, 532 and 534 as controlled by valves 520, 522.

The final two manual control valves 536, 538 on valve bank 502 to the right of the operator control the right and left auger rotation drive motors 328 on screed assembly 300. When opened, valves 536, 538 allow fluid flow through hydraulic lines 540, 542 respectively through the swivel connections on reels 333, 334 to the auger drive motors which rotate the augers 304, 306 as described above. Storage of the extendable hydraulic lines 540, 542 is accommodated on hose reels 333, 334 on the sides of the operator platform 112 as described above.

A final operation controlled and powered by pump 163 is the vehicle propulsion via propulsion motor 80 and automatic fluid brake 82 described above. Pressure from hydraulic line 500 is fed through line 543 and fluid flow control valve 544 which allows the speed of the machine to be increased for rapid propulsion to a work area or slowed for screeding by moving the machine directly through concrete with the screeding apparatus positioned behind the rear wheels of the apparatus. From control valve 544 hydraulic fluid is fed through a three position, manually controlled spool valve 546 also located to the right of the operator. Valve 546 provides fluid flow through hydraulic lines 548, swivel 610 and dual counterbalancing valve 89 to propulsion motor 80 and fail safe brake 82 as described above. Depending on the direction in which the valve 546 is moved, motor 80 will be driven in forward or reverse for forward or reverse vehicle propulsion. As mentioned, dual counterbalancing valve 89 is a pilot operated, dual release valve including a small shuttle valve which releases brake 82 as soon as fluid pressure is provided to motor 80 but actuates brake 82 when hydraulic pressure is removed from motor 80 by closing valve 546. Hydraulic fluid is returned to tank 150 through hydraulic lines 550, 552, 554 and 556 from valve bank 502, and valves 520, 522 and 546 respectively.

To the left of the operator on platform 112 is a second bank or series of eight manually controlled, spring return biased hydraulic fluid flow control valves 560. Hydraulic fluid from accumulator tank 167 and second hydraulic pump 164 is fed through hydraulic lines 530, 531 and 562 to the series of eight valves 560.

The first valve 564 controls fluid flow through hydraulic lines 566 and fluid swivel 610 to front axle oscillation lock cylinders 60, 62. Fluid valve 564 includes a fourth position for locking fluid in cylinders 60, 62 and preventing any seepage or escape of the fluid to hold the cylinders and thus the front axle against pivoting or oscillation when desired when the machine is in working position.

The second fluid valve 568 in series 560 provides hydraulic fluid through lines 570 and fluid swivel 610 to rear axle steering cylinders 76*a*, 76*b*. Third valve 572 provides hydraulic fluid through lines 574 and swivel 610 to front axle steering cylinders 58*a*, 58*b*. By moving valves 568, 572 in the desired direction the wheels on the front and rear axles may be pivoted left or right independently of one another to steer the machine. As is also apparent, other types of steering controls could be used with the machine instead of simple push-pull handles on the control valves, e.g. conventionally known steering wheel controls or the like.

The next two valves 576, 580 in valve bank 560 are manual control override valves for applying hydraulic fluid through lines 578, 582 and swivel connections on reels 252, 256 to right and left screed elevation control cylinders 386, 388 respectively. Hydraulic lines 578, 582 are respectively wound and extended from spring biased hose reels 256, 252 respectively as trolley 240 moves as mentioned above. Valves 576, 580 are only used for gross changes in elevation of the screed assembly 300. Normally, automatic elevation control via the laser beacon reference plane control system described above is maintained through solenoid operated fluid valves 402 which obtain hydraulic fluid pressure through hydraulic lines 530 and 584, but are interconnected to lines 578, 582 via hydraulic lines 586 and 588. Accordingly, automatic elevation control of the screed assembly 300 via valves 402, which include fluid flow controls for adjusting the speed of operation of cylinders 388, 386, occurs through valves 402 unless a major change in elevation is desired when valves 576 and 580 are used.

The final three manually controlled valves is series 560 including valves 590, 594 and 598 control operation of the right rear stabilizer cylinder 23*a*, left front and left rear stabilizer cylinders 23*b* and 23*c*, and right front stabilizer cylinder 23*d* respectively. Thus, valve 590 when opened provides hydraulic fluid through hydraulic lines 592 through fluid swivel 610 and lock valve 593 to cylinder 23*a*. Valve 594 controls fluid flow through hydraulic lines 596 and fluid swivel 610 to both the left front and left rear stabilizer cylinders 23*b*, 23*c* simultaneously through lock valves 595 and 597 respectively. Similarly, valve 598 controls fluid flow through lines 600, swivel 610, through lock valve 601 to right front stabilizer cylinder 23*d*. Lock valves 593, 595, 597 and 601 hold the hydraulic fluid within the stabilizer cylinders and prevent leakage therefrom to hold the machine in proper working position adjacent unpoured concrete during operation.

Accordingly, the present apparatus in any of its preferred forms is useful for screeding, smoothing, distributing and leveling placed and/or poured, uncured concrete or other like materials either automatically from a position adjacent the concrete or material by moving the screed assembly toward the vehicle along the cantilevered boom at a controlled rate after the boom has been rotationally positioned or vertically positioned on pivot 417 and the vehicle stabilized and locked in position with cylinders 23, 60 and 62. Alternately, the machine may be driven directly through the placed and/or poured, uncured concrete or like materials with the screed assembly in a fixed location on movable boom 170 or on fixed boom 444 behind the rear wheels. In all cases, elevation control of the screeding apparatus is automatic with the laser beacon reference plane control system in relation to the fixed position of a laser beacon reference plane positioned off the vehicle. The machine, therefore, provides economies in finishing placed and/or poured concrete and other materials by reducing labor requirements and allowing screeding of large areas without requiring curing or use of adjacent strips before successive strips can be finished.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows:

1. A self-propelled screeding apparatus for placed and/or poured, uncured concrete or like loose or plastic materials previously placed on the ground or another support surface comprising:

a frame;

propulsion means on said frame for moving said frame over the ground or support surface;

a boom;

boom support means for mounting said boom in cantilevered fashion from said frame;

screed means for spreading and/or smoothing the loose or plastic material; and screed mounting means for mounting said screed means for movement toward and away from said frame on said boom whereby said screed means may be moved on said boom for spreading and/or smoothing concrete or other material on the ground or other support surface adjacent to said apparatus or may be secured in a predetermined position on said boom for spreading and/or smoothing the material as said apparatus is moved through the material.

2. A self-propelled screeding apparatus for placed and/or poured, uncured concrete or like loose or plastic materials previously placed on the ground or another support surface comprising:

a frame;

propulsion means on said frame for moving said frame over the ground or support surface;

a boom;

boom support means for mounting said boom in cantilevered fashion from said frame;

screed means for spreading and/or smoothing the loose or plastic material;

screed mounting means for mounting said screed means on said boom for movement with respect to said frame and boom whereby said screed means may be moved along said boom for spreading and/or smoothing concrete or other material on the ground or other support surface adjacent to said apparatus or may be secured in a predetermined position on said boom for spreading and/or smoothing the material as said apparatus is moved through the material;

said boom support means including rotational boom mounting means for rotatably supporting said boom on said frame whereby said screed means may be positioned around said apparatus.

3. The screeding apparatus of claim 2 wherein said boom support means include means for extending and retracting said boom with respect to said frame.

4. The screeding apparatus of claim 3 wherein said frame includes upper and lower portions; said rotational boom mounting means including a bearing having a vertical axis of rotation mounted between said upper and lower frame portions; said boom including a rectilinear beam; and boom support bearing means for mounting said beam for generally horizontal movement on said upper frame portion.

5. The screeding apparatus of claim 4 including boom drive motor means for extending and retracting said beam with respect to said upper frame portion, and clamping means on said upper frame portion for securing said beam in a desired position.

6. The screeding apparatus of claim 5 wherein said boom drive means includes at least one drive chain extending along said beam, a drive sprocket engaging said drive chain, and a motor on said upper frame portion for driving said drive sprocket to move said chain and beam on said boom support bearing means.

7. The screeding apparatus of claim 5 wherein rotational boom mounting means include rotation drive motor means for rotating said upper frame portion with respect to said lower frame portion; said upper frame portion also including an operator platform.

8. The screeding apparatus of claim 2 wherein said boom support means includes pivot means for pivoting said boom in a generally vertical plane with respect to said frame whereby said screed means may be raised and lowered and said boom positioned at various angles for spreading and/or smoothing materials on sloped surfaces.

9. The screeding apparatus of claim 8 wherein said boom is a rectilinear beam; said pivot means including a pivot member have a generally horizontal pivot axis securing said beam to said frame and power means connected between said frame and beam for moving said beam about said pivot member.

10. A self-propelled screeding apparatus for placed and/or poured, uncured concrete or like loose or plastic materials previously placed on the ground or another support surface comprising:

a frame;

propulsion means on said frame for moving said frame over the ground or support surface;

a boom;

boom support means for mounting said boom in cantilevered fashion from said frame;

screed means for spreading and/or smoothing the loose or plastic material;

screed mounting means for mounting said screed means on said boom for movement with respect to said frame and boom whereby said screed means may be moved along said boom for spreading and/or smoothing concrete or other material on the ground or other support surface adjacent to said apparatus or may be secured in a predetermined position on said boom for spreading and/or smoothing the material as said apparatus is moved through the material;

said screed mounting means including trolley means mounted on said boom for movably supporting said screed means, said trolley means including trolley bearing means engaging said boom for moving said trolley means along said boom and suspension means for suspending said screed means from said trolley means; said screed mounting means also including trolley drive motor means for moving said trolley means along said boom.

11. The screeding apparatus of claim 10 wherein said trolley means is a trolley member mounted atop said boom; said trolley bearing means including a plurality of rollers supporting said trolley member on said boom; said trolley drive motor means including an endless drive chain mounted on idler sprockets on said boom, said trolley member being secured to said drive chain, a drive sprocket engaging said drive chain and a motor for driving said drive sprocket to move said chain and trolley member on said rollers along said boom.

12. The screeding apparatus of claim 1 wherein said screed means includes a screed assembly having a generally horizontally extending screed support, a generally horizontally extending auger rotatably mounted on said screed support for moving the material to be spread axially along said auger, auger drive means for rotating said auger, striker means for engaging, spreading and smoothing the material to be spread, and vibration means for vibrating said screed support, auger, auger drive means and striker means to facilitate spreading and smoothing of the material.

13. A self-propelled screeding apparatus for placed and/or poured, uncured concrete or like loose or plastic materials previously placed on the ground or another support surface comprising:

a frame;

propulsion means on said frame for moving said frame over the ground or support surface;

a boom;

boom support means for mounting said boom in cantilevered fashion from said frame;

screed means for spreading and/or smoothing the loose or plastic material;

screed mounting means for mounting said screed means on said boom for movement with respect to said frame and boom whereby said screed means may be moved along said boom for spreading and/or smoothing concrete or other material on the ground or other support surface adjacent to said apparatus or may be secured in a predetermined position on said boom for spreading and/or smoothing the material as said apparatus is moved through the material;

said screed means including a screed assembly having a generally horizontally extending screed support, a generally horizontally extending auger rotatably mounted on said screed support for moving the material to be spread axially along said auger, auger drive means for rotating said auger, striker means for engaging, spreading and smoothing the material to be spread, and vibration means for vibrating said screed support, auger, auger drive means and striker means to facilitate spreading and smoothing of the material;

said screed means further including elevation means for raising and lowering said screed assembly with respect to said boom, and screed control means for automatically controlling the elevation of said screed assembly with said elevation means in response to a fixed reference external of said apparatus.

14. The screeding apparatus of claim 13 wherein said elevation means includes a screed elevation beam rigidly mounted generally horizontally on said screed mounting means, spaced elevation tubes secured to said screed assembly and mounted at opposed ends of said screed elevation beam, power means for raising and lowering said elevation tubes with respect to said screed elevation beam, at least one of said elevation tubes being pivotally mounted to said screed assembly.

15. The screeding apparatus of claim 14 wherein said one elevation tube includes flexible pivot joint means for pivotally mounting said one tube on said screed assembly, said flexible pivot joint means including an elongated fastener having a central axis extending therethrough and being relatively inflexible radially of said axis of said fastener but relatively flexible axially of said axis of said fastener in said pivotal mounting for reducing the amount of vibration transmitted from said screed assembly to said screed control means.

16. The screeding apparatus of claim 14 wherein said power means include a fluid cylinder extending between said screed elevation beam and each of said elevation tubes; said screed control means including a laser beam receiver mounted on each elevation tube for detecting and receiving a laser beacon defining a fixed reference plane and generating an electrical signal indicating the position of said receiver relative to said laser beacon reference plane, a source of fluid under pressure for extending said fluid cylinders, electrically controlled fluid valves for controlling fluid flow from said fluid source to said fluid cylinders, and electrical control means responsive to said signals from said laser beacon receivers for opening and closing said fluid values.

17. The screeding apparatus of claim 13 wherein said striker means is mounted behind said auger and includes a generally horizontal striker member, a generally vertical support flange for said striker member and means for adjusting the vertical position of said striker member and support flange with respect to said auger.

18. The screeding apparatus of claim 17 wherein said striker means further includes a forwardly extending edge for cutting through the material to be spread to help reduce any buildup of material ahead of said striker member.

19. The screeding appartus of claim 13 wherein said screed assembly includes a second auger rotatably mounted coaxially with but at the end of said first auger and second auger drive means for rotating said second auger whereby said augers may be rotated in the same rotational direction or opposite rotational directions to move the material to be spread inwardly, outwardly or from one end of said screed assembly to the other.

20. A self-propelled screeding apparatus for placed and/or poured, uncured concrete or like loose or plastic materials previously placed on the ground or another support surface comprising:

a frame;

propulsion means on said frame for moving said frame over the ground or support surface;

a boom;

boom support means for mounting said boom in cantilevered fashion from said frame;

screed means for spreading and/or smoothing the loose or plastic material;

screed mounting means for mounting said screed means on said boom for movement with respect to said frame and boom whereby said screed means may be moved along said boom for spreading and/or smoothing concrete or other material on the ground or other support surface adjacent to said apparatus or may be secured in a predetermined position on said boom for spreading and/or smoothing the material as said apparatus is moved through the material;

said screed means further including elevation means for raising and lowering said screed means with respect to said boom and screed control means for automatically controlling the elevation of said screed means with said elevation means in response to a fixed reference external of said apparatus.

21. The screeding apparatus of claim 20 wherein said elevation means include at least one fluid cylinder; said screed control means including a laser beam receiver mounted on said elevation means for detecting and receiving a laser beacon defining a fixed reference plane and generating an electrical signal indicating the position of said receiver relative to said laser beacon reference plane, a source of fluid under pressure for extending said fluid cylinder, electrically controlled fluid valve means for controlling fluid flow from said fluid source to said fluid cylinder, and electrical control means responsive to said signal from said laser beacon receiver for opening and closing said fluid valve means.

22. A self-propelled screeding apparatus for placed and/or poured, uncured concrete or like loose or plastic materials previously placed on the ground or another support surface comprising:

a frame;

propulsion means on said frame for moving said frame over the ground or support surface;

a boom;

boom support means for mounting said boom in cantilevered fashion from said frame;

screed means for spreading and/or smoothing the loose or plastic material;

screed mounting means for mounting said screed means on said boom for movement with respect to said frame and boom whereby said screed means may be moved along said boom for spreading and/or smoothing concrete or other material on the ground or other support surface adjacent to said apparatus or may be secured in a predetermined position on said boom for spreading and/or smoothing the material as said apparatus is moved through the material;

said frame including a first rigid framework and a pair of spaced axle means for receiving support wheels thereon mounted on said first framework; said axle means respectively supporting front and rear pairs of support wheels thereon; at least one of said axle means including pivot means at each end for turning said wheels; and extendable stabilizer means for engaging the ground and supporting and leveling said frame and apparatus during use of said screed means.

23. The screeding apparatus of claim 22 wherein said frame includes a second framework rotatably mounted atop said first framework, an operator platform mounted on said second framework, and bearing means intermediate said first and second framework for rotating said second framework with respect to said first framework; rotating drive motor means for rotating said second framework with respect to said first framework; said second framework including said boom support means whereby said boom is rotatable with said second framework for positioning said screed means at various positions around said apparatus.

24. The screeding apparatus of claim 23 including hydraulic power means on one of said frameworks for operating said propulsion means, screed means, screed mounting means, pivot means on said one axle means, and rotation drive motor means; said hydraulic power means including hydraulic swivel means for transfering hydraulic fluid under pressure between said rotatable frameworks.

25. The screeding apparatus of claim 22 wherein at least one of said axle means is pivotally mounted on said first framework such that it oscillates about a generally horizontal axis; oscillation lock means for engaging said pivotable axle means on either side of said axis to hold said pivotable axle means in a desired position.

26. The screeding apparatus of claim 25 wherein said oscillation lock means include a pair of pivotable links on said first framework, one link on either side of said axis for said pivotable axle means, and a fluid cylinder mounted between each of said links and said first framework, said cylinders being extendable to engage said links with said axle means to hold said axle means in position.

27. The screeding apparatus of claim 22 wherein said propulsion means include propulsion drive motor means drivingly connected to at least one of said axle means for rotating said support wheels on said axle means, said axle means which is drivingly connected to said propulsion drive motor means including transmission/differential means for transmitting rotational motion to said support wheels.

28. The screeding apparatus of claim 1 wherein said boom support means includes pivot means for pivoting said boom in a generally vertical plane with respect to said frame whereby said screed means may be raised and lowered and said boom positioned at various angles for spreading and/or smoothing materials on sloped surfaces.

29. A self-propelled screeding apparatus for various loose or plastic materials previously placed on the ground or another support surface such as placed and/or poured concrete, sand, gravel or the like comprising:

a frame;

propulsion means on said frame for moving said frame over the ground or other support surface;

a boom;

rotational boom mounting means on said frame for rotatably supporting said boom on said frame;

screed means on said boom for spreading and leveling material on the ground or other support surface adjacent said apparatus;

screed mounting means for mounting said screed means on said boom for movement with respect to said frame and boom;

control means on said screed means for automatically controlling the elevation of said screed means with respect to said boom and frame in response to a fixed reference whereby said screed means may be moved on said boom or said apparatus may be moved with said screed means in a fixed position along said boom to spread and/or level the loose or plastic material adjacent the apparatus, said boom being rotatable to position said screed means on said frame for spreading and/or leveling material in selected areas around said apparatus.

30. The screeding apparatus of claim 29 including means for extending and retracting said boom with respect to said frame to avoid obstacles when said apparatus is moved from one position to another with said propulsion means.

31. The screeding apparatus of claim 30 wherein said frame includes upper and lower portions; said rotational boom mounting means including a bearing having a vertical axis of rotation mounted between said upper and lower frame portions; said boom including a rectilinear beam; and boom support bearing means for mounting said beam for generally horizontal movement on said upper frame portion.

32. The screeding apparatus of claim 31 including boom drive motor means for extending and retracting said beam with respect to said upper frame portion, and clamping means on said upper frame portion for securing said beam in a desired position.

33. The screeding apparatus of claim 32 wherein said rotational boom mounting means include rotation drive motor means for rotating said upper frame portion with respect to said lower frame portion; said upper frame portion also including an operator platform.

34. The screeding apparatus of claim 29 wherein said rotational boom mounting means includes pivot means for pivoting said boom in a generally vertical plane with respect to said frame whereby said screed means may be raised and lowered and said boom positioned at various angles for spreading and/or smoothing materials on sloped surfaces.

35. The screeding apparatus of claim 29 wherein said screed mounting means includes trolley means mounted on said boom for movably supporting said screen means, said trolley means including trolley bearing means engaging said boom for moving said trolley means along said boom and suspension means for suspending said screed means from said trolley means; said screed mounting means also including trolley drive motor means for moving said trolley means along said boom.

36. The screeding apparatus of claim 29 wherein said screed means includes a screed assembly having a generally horizontally extending screed support, a generally horizontally extending auger rotatably mounted on said screed support for moving the material to be spread axially along said auger, auger drive means for rotating said auger, striker means for engaging, spreading and smoothing the material to be spread, and vibration means for vibrating said screed support, auger, auger drive means and striker means to facilitate spreading and smoothing of the material.

37. The screeding apparatus of claim 36 wherein said screed means further includes elevation means for raising and lowering said screed assembly with respect to said boom.

38. the screeding apparatus of claim 37 wherein said elevation means includes a screed elevation beam rigidly mounted generally horizontally on said screed mounting means, spaced elevation tubes secured to said screed assembly and mounted at opposed ends of said screed elevation beam, power means for raising and lowering said elevation tubes with respect to said screed elevation beam, both of said elevation tubes being pivotaly mounted to said screed assembly.

39. The screeding apparatus of claim 38 wherein said one elevation tube includes flexible pivot joint means for pivotally mounting said one tube on said screed assembly, said flexible pivot joint means including an elongated fastener having a central axis extending therethrough and being relatively inflexible radially of said axis of said fastener but relatively flexible axially of said axis of said fastener in said pivotal mounting for reducing the amount of vibration transmitted from said screen assembly to said screed control means.

40. The screeding apparatus of claim 38 wherein said power means include a fluid cylinder extending between said screed elevation beam and each of said elevation tubes; said screed control means including a laser beam receiver mounted on each elevation tube for detecting and receiving a laser beacon defining a fixed reference plane and generating an electrical signal indicating the position of said receiver relative to said laser beacon reference plane, a source of fluid under pressure for extending said fluid cylinders, electrically controlled fluid valves for controlling fluid flow from said fluid source to said fluid cylinders, and electrical control means responsive to said signals from said laser beacon receivers for opening and closing said fluid valves.

41. The screeding apparatus of claim 29 wherein said frame includes a first rigid framework and a pair of spaced axle means for receiving support wheels thereon mounted on said first framework; said axle means respectively supporting front and rear pairs of support wheels thereon; at least one of said axle means including pivot means at each end for turning said wheels; and extendable stabilizer means for engaging the ground and supporting and leveling said frame and apparatus during use of said screed means.

42. The screeding apparatus of claim 41 wherein said frame includes a second framework rotatably mounted atop said first framework, an operator platform mounted on said second framework, and bearing means intermediate said first and second framework for rotating said second framework with respect to said first framework; rotation drive motor means for rotating said second framework with respect to said first framework; said second framework including said rotational boom mounting means whereby said boom is rotatable with said second framework for positioning said screed means at various positions around said apparatus.

43. The screeding apparatus of claim 42 including hydraulic power means on one of said frameworks for operating said propulsion means, screed means, screed mounting means, pivot means on said one axle means, and rotation drive motor means; said hydraulic power means including hydraulic swivel means for transfering hydraulic fluid under pressure between said rotatable frameworks.

44. A self-propelled screeding apparatus for placed and/or poured, uncured concrete or like loose or plastic materials previously placed on the ground or another support surface comprising:

a frame;

propulsion means on said frame for moving said frame over the ground or other support surface;

a boom;

boom support beams for mounting said boom in cantilevered fashion from said frame;

screed means mounted on said boom behind said propulsion means for spreading and/or smoothing the loose or plastic material such as uncured concrete and filling in any tracks made by said propulsion means; and laser beam elevation control means on said boom for automatically controlling the elevation of said screed means with respect to said boom and frame in response to a fixed laser beacon reference located off said apparatus whereby said apparatus may be moved through the material to be spread with said screed means thereon to spread and/or level the loose or plastic material behind the apparatus while the finished height of the material is automatically controlled.

45. A self-propelled screeding apparatus for placed and/or poured, uncured concrete or like loose or plastic materials previously placed on the ground or another support surface comprising:

a frame;

propulsion means on said frame for moving said frame over the ground or other support surface;

a boom;

boom support means for mounting said boom in cantilevered fashion from said frame;

screed means mounted on said boom behind said propulsion means for spreading and/or smoothing the loose or plastic material such as uncured concrete and filling in any tracks made by said propulsion means;

elevation control means on said boom for automatically controlling the elevation of said screed means with respect to said boom and frame in response to a fixed reference located off said apparatus whereby said apparatus may be moved through the material to be spread with said screed means thereon to spread and/or level the loose or plastic material behind the apparatus while the finished height of the material is automatically controlled;

said elevation control means including at least one fluid cylinder, a laser beam receiver for detecting and receiving a laser beacon defining a fixed reference plane and generating an electrical signal indicating the position of said receiver relative to said laser beacon reference plane, a source of fluid under pressure for extending said fluid cylinder, electrically controlled fluid valve means for controlling fluid flow from said fluid source to said fluid cylinder, and electrical control means responsive to said signal from said laser beacon receiver for opening and closing said fluid valve means.

46. A method of screeding placed and/or poured, uncured concrete or like material with a screeding vehicle comprising:

propelling the vehicle through the placed and/or poured, uncured concrete or like material such that the support means for supporting the vehicle on the ground or other surface pass directly through the concrete or other material;

screeding the uncured concrete or other material with a screed means mounted on the vehicle for leveling and/or spreading and smoothing the concrete or other material, said screeding occurring behind the vehicle support means by engaging the screed means with the concrete or other material behind the vehicle support means; and controlling the position of said screed means with respect to a fixed laser beacon reference located external to said vehicle with a control means on said vehicle.

47. The method of claim 46 wherein said vehicle is propelled in a predetermined path of travel through the concrete or other material, said screeding including moving the placed and/or poured, uncured concrete or other material in front of said screed means in a lateral direction across the path of travel to form an evenly distributed layer of concrete or other material.

48. The method of claim 47 wherein said screeding further includes vibrating said screed means to smooth the distributed layer of concrete or other material.

49. The method of claim 46 including filling in the tracks made in the concrete or other material by the vehicle support means.

50. A method of screeding placed and/or poured, uncured concrete or like material with a screeding vehicle comprising:

propelling the vehicle through the placed and/or poured, uncured concrete or like material such that the support means for supporting the vehicle on the ground or other surface pass directly through the concrete or other material;

screeding the uncured concrete or other material with a screed means mounted on the vehicle for leveling and/or spreading and smoothing the concrete or other material, said screeding occurring behind the vehicle support means by engaging the screed means with the concrete or other material behind the vehicle support means;

controlling the position of said screed means with respect to a fixed reference located external to said vehicle with a control means on said vehicle;

filling in the tracks made in the concrete or other material by the vehicle support means by plowing the concrete or other material adjacent the tracks into the tracks with deflector means on the screed means.

51. The method of claim 46 wherein said controlling includes raising and lowering the screed means with motive power means on the vehicle.

52. The method of claim 51 including providing a fixed reference plane with a laser beacon positioned off the vehicle, receiving the laser beacon with a laser beacon receiver on the vehicle, generating a signal indicating the position of the screed means relative to the reference plane with a signal means on the vehicle, and operating the motive power means to raise or lower the screed means in response to the signal from the signal means.

53. The method of claim 52 wherein said vehicle is propelled in a predetermined path of travel through the concrete or other material, said screeding including moving the placed and/or poured, uncured concrete or other material in front of said screed means in a lateral direction across the path of travel to form an evenly distributed layer of concrete or other material; and vibrating said screed means to smooth the distributed layer of concrete or other material.

54. The method of claim 53 including filling in the tracks made in the concrete or other material by the vehicle support means.

55. A method for screeding placed and/or poured, uncured concrete and like materials with a screeding vehicle comprising:

positioning a vehicle with a screed means movably mounted thereon adjacent an area of placed and/or poured, uncured concrete or like material;

positioning the screed means over the placed and/or poured, uncured concrete or like material at a first position away from the vehicle;

engaging the screed means with the concrete or like material at said first position and moving the screed means along a path of movement at a controlled rate toward the vehicle to a second position adjacent the vehicle while moving the concrete laterally of and in a direction transverse to said path of movement of said screed means to evenly distribute the concrete and while controlling the elevation of said screed means relative to a fixed reference located external to said vehicle and screed means.

56. The method of claim 55 wherein moving said screed means toward said vehicle includes moving a support with the screed means suspended therefrom with a first motive power means along a boom supported on the vehicle in cantilevered position over the concrete or like material while adjusting the elevation of the screed means with a second motive power means relative to the fixed reference.

57. The method of claim 56 including providing a fixed reference plane with a laser beacon positioned off the vehicle, receiving the laser beacon with a laser beacon receiver on the vehicle, generating a signal indicating the position of the screed means relative to the reference plane with a signal means on the vehicle, and operating the motive power means to raise or lower the screed means in response to the signal from the signal means.

58. A method for screeding placed and/or poured, uncured concrete and like materials with a screeding vehicle comprising:

positioning a vehicle with a screed means movably mounted thereon adjacent an area of placed and/or poured, uncured concrete or like material;

positioning the screed means over the placed and/or poured, uncured concrete or like material at a first position away from the vehicle;

engaging the screed means with the concrete or like material at said first position and moving the screed means at a controlled rate toward a second position adjacent the vehicle while controlling the elevation of said screed means relative to a fixed reference located external to said vehicle and screed means;

said moving said screed means toward said vehicle including moving a support with the screed means suspended therefrom with a first motive power means along a boom supported on the vehicle in cantilevered position over the concrete or like material while adjusting the elevation of the screed means with a second motive power means relative to the fixed reference; and said screed means being moved along a rectilinear path toward said vehicle and being positioned transverse to and on either side of said rectilinear path.

59. The method of claim 58 including moving the placed and/or poured, uncured concrete or like material in front of said screed means in a lateral direction across the path of travel to form an evenly distributed layer of concrete or like material.

60. The method of claim 59 including vibrating said screed means to smooth the distributed layer of concrete or like material.

61. The method of claim 60 including pivoting said boom about a generally horizontal axis to position the boom at an inclined angle to said vehicle and/or to the horizontal prior to moving the support along the boom toward the vehicle whereby screeding is performed on slopes or other inclined surfaces.

62. A method for screeding placed and/or poured, uncured concrete and like materials with a screeding vehicle comprising:

positioning a vehicle with a screed means movably mounted thereon adjacent an area of placed and/or poured, uncured concrete or like material;

positioning the screed means over the placed and/or poured, uncured concrete or like material at a first position away from the vehicle;

engaging the screed means with the concrete or like material at said first position and moving the screed means at a controlled rate toward a second position adjacent the vehicle while controlling the elevation of said screed means relative to a fixed reference located external to said vehicle and screed means;

said moving said screed means toward said vehicle including moving a support with the screed means suspended therefrom with a first motive power means along a boom supported on the vehicle in cantilevered position over the concrete or like material while adjusting the elevation of the screed means with a second motive power means relative to the fixed reference; and leaving and stabilizing said vehicle prior to moving said screed means toward said vehicle by extending stabilizer supports positioned at spaced locations on said vehicle.

63. A method for screeding placed and/or poured, uncured concrete and like materials with a screeding vehicle comprising:

positioning a vehicle with a screed means movably mounted thereon adjacent an area of placed and/or poured, uncured concrete or like material;

positioning the screed means over the placed and/or poured, uncured concrete or like material at a first position away from the vehicle;

engaging the screed means with the concrete or like material at said first position and moving the screed means at a controlled rate toward a second position adjacent the vehicle while controlling the elevation of said screed means relative to a fixed reference located external to said vehicle and screed means;

said moving said screed means toward said vehicle including moving a support with the screed means suspended therefrom with a first motive power means along a boom supported on the vehicle in cantilevered position over the concrete or like material while adjusting the elevation of the screed means with a second motive power means relative to the fixed reference; and pivoting said boom about a generally horizontal axis to position the boom at an inclined angle to said vehicle and/or to the horizontal prior to moving the support along the boom toward the vehicle whereby screeding is performed on slopes or other inclined surfaces.

* * * * *

UNITED STATES PATENT AND TRADEMARK OFFICE

CERTIFICATE OF CORRECTION

PATENT NO. : 4,655,633

DATED : April 7, 1987

INVENTOR(S) : David W. Somero, Paul J. Somero and Philip J. Quenzi

It is certified that error appears in the above-identified patent and that said Letters Patent is hereby corrected as shown below:

In the Abstract, line 5:

"drive" should be --driven--

Column 5, line 3:

After "trolley assembly 240" insert --from--

Column 10, line 62:

"prvent" should be --prevent--

Column 15, line 13:

"assemby" should be --assembly--

Column 25, claim 23, line 37:

"rotating" (first occurrence) should be --rotation--

Column 27, claim 39, line 45:

"screen" should be --screed--

UNITED STATES PATENT AND TRADEMARK OFFICE

CERTIFICATE OF CORRECTION

PATENT NO. : 4,655,633

DATED : April 7, 1987

INVENTOR(S) : David W. Somero, Paul J. Somero and Philip J. Quenzi

It is certified that error appears in the above-identified patent and that said Letters Patent is hereby corrected as shown below:

Column 29, claim 46, line 35:

After "vehicle" insert --which receives and responds to said laser beacon reference--

Column 32, claim 62, line 15:

"leaving" should be --leveling--

Signed and Sealed this

Ninth Day of February, 1988

*Attest:*

*Attesting Officer*

DONALD J. QUIGG

*Commissioner of Patents and Trademarks*